US008086143B2

(12) United States Patent
Nagayama et al.

(10) Patent No.: US 8,086,143 B2
(45) Date of Patent: Dec. 27, 2011

(54) IMAGE FORMING APPARATUS FOR USE WITH CARRIER INCLUDING A CORE AND COVER LAYER

(75) Inventors: Masashi Nagayama, Machida (JP); Tomio Kondou, Numazu (JP); Shinichiro Yagi, Numazu (JP); Hitoshi Iwatsuki, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 622 days.

(21) Appl. No.: 12/209,607

(22) Filed: Sep. 12, 2008

(65) Prior Publication Data

US 2009/0074450 A1 Mar. 19, 2009

(30) Foreign Application Priority Data

Sep. 13, 2007 (JP) ..... 2007-238424
Jul. 31, 2008 (JP) ..... 2008-197829

(51) Int. Cl.
*G03G 15/08* (2006.01)

(52) U.S. Cl. ..... 399/254; 399/258; 430/111.32

(58) Field of Classification Search ..... 399/254–259, 399/262; 430/105, 111.35, 111.32
See application file for complete search history.

(56) References Cited

U.S. PATENT DOCUMENTS 6,096,466 A 8/2000 Imai et al.
7,144,669 B2 12/2006 Suzuki et al.
7,252,919 B2 8/2007 Suzuki et al.
7,381,513 B2 6/2008 Suzuki et al.
7,826,776 B2 * 11/2010 Tsuda et al. ..... 399/255
7,835,671 B2 * 11/2010 Suzuki ..... 399/254
7,835,672 B2 * 11/2010 Sakamoto et al. ..... 399/254
7,904,001 B2 * 3/2011 Tateyama et al. ..... 399/254
2005/0079434 A1 4/2005 Suzuki et al.
2005/0158643 A1 7/2005 Yamaguchi et al.
2006/0057487 A1 3/2006 Nagayama et al.
2006/0210905 A1 9/2006 Imahashi et al.
2006/0210906 A1 9/2006 Suzuki et al.
2006/0251982 A1 11/2006 Iwatsuki et al.
2007/0015078 A1 1/2007 Suzuki et al.
2007/0048652 A1 3/2007 Imahashi et al.
2007/0202430 A1 8/2007 Suzuki et al.
2007/0243482 A1 10/2007 Yamaguchi et al.
2008/0063969 A1 3/2008 Yamaguchi et al.
2008/0073252 A1 3/2008 Yamaguchi et al.

(Continued)

FOREIGN PATENT DOCUMENTS

JP 57-168255 10/1982

(Continued)

*Primary Examiner* — William J Royer
(74) *Attorney, Agent, or Firm* — Oblon, Spivak, McClelland, Maier & Neustadt, L.L.P.

(57) ABSTRACT

An image forming apparatus including an image bearing member; and a developing device including a developer bearing member, a developer containing portion, a developer supplying passage supplying the developer to the developer bearing member while feeding the developer in a direction, and a developer agitating passage feeding a mixture of the developer fed through the developer supplying passage without used for developing, and the developer used for developing, in the opposite direction. The developer supplying passage, and developer agitating passage are separated from each other except for at least both the end portions. The developer includes a toner and a carrier having a cover layer thereon, which includes a binder resin and a particulate material. The ratio of the volume average particle diameter of the particulate material to the average thickness of the resinous portion of the cover layer is greater than 1 and less than 10.

20 Claims, 17 Drawing Sheets

U.S. PATENT DOCUMENTS

| | | | |
|---|---|---|---|
| 2008/0152393 | A1 | 6/2008 | Nagayama et al. |
| 2008/0213684 | A1 | 9/2008 | Nagayama et al. |

FOREIGN PATENT DOCUMENTS

| | | |
|---|---|---|
| JP | 58-108548 | 6/1983 |
| JP | 58-117555 | 7/1983 |
| JP | 59-100471 | 6/1984 |
| JP | 2-79862 | 3/1990 |
| JP | 3-145678 | 6/1991 |
| JP | 5-273789 | 10/1993 |
| JP | 6-51634 | 2/1994 |
| JP | 6-202381 | 7/1994 |
| JP | 8-6307 | 1/1996 |
| JP | 8-234550 | 9/1996 |
| JP | 9-160304 | 6/1997 |
| JP | 11-167260 | 6/1999 |
| JP | 11-223960 | 8/1999 |

* cited by examiner

IMAGE FORMING APPARATUS FOR USE WITH CARRIER INCLUDING A CORE AND COVER LAYER

BACKGROUND OF THE INVENTION

1. Field of the Invention

The present invention relates to an image forming apparatus. More particularly, the present invention relates to an image forming apparatus which forms visual images using a two-component developer including a toner and a carrier.

2. Discussion of the Background

One of background developing devices using a two-component developer including a toner and a magnetic carrier is illustrated in FIG. 1. Referring to FIG. 1, a background developing device 4*a* has two separated developer passages, i.e., a first developer passage for supplying a developer to a developing roller 5 (serving as a developer bearing member) and a second developer passage 10 (i.e., a developer agitating passage) for agitating the developer. The developer in the first developer passage is fed in a direction opposite to the feeding direction of the developer in the second developer passage 10 so that the developer is circulated in the two developer passages. In FIG. 1, numerals 401, 403 and 11 denote a first auger for feeding the developer, a partition, and a second auger.

In the background developing device 4*a* illustrated in FIG. 1, the first developer passage for supplying a developer to the developing roller 5 also serves as a developer collecting passage for collecting the developer passing through a development region while being used for developing electrostatic latent images on an image bearing member. Therefore, the concentration of toner in the developer decreases in the developer feeding direction in the first developer passage. Namely, the developer on the downstream side in the first developer passage relative to the developer feeding direction has lower toner concentration than the developer on the upstream side. Therefore, a problem in that images having uneven image density are formed occurs.

In attempting to avoid such an uneven density image problem, published unexamined Japanese patent applications Nos. (hereinafter referred to as JP-As) 06-51634 and 11-167260 have proposed developing devices in which a developer supplying auger and a developer collecting auger for collecting the developer used for developing are arranged in different developer passages. Hereinafter, each of the background developing devices will be explained in detail.

The background developing device proposed by JP-A 06-51634 is illustrated in FIG. 2. Referring to FIG. 2, a background developing device 4*b* includes a developer supplying passage 9 for supplying a developer to a developing roller 5, and a developer collecting passage 7 for collecting the developer passing through a development region at which the developing roller 5 is opposed to an electrostatic latent image bearing member 1, wherein the developer collecting passage 7 is separated from the developer supplying passage 9. Since the developer passing through the development region is fed to the developer collecting passage 7, the developer is not mixed with the developer in the developer supplying passage 9. Therefore, the toner concentration of the developer in the developer supplying passage 9 (i.e., the toner concentration of the developer fed to the developing roller 5) hardly changes.

However, the collected developer fed to the developer collecting passage 7 is shortly supplied to the developer supplying passage 9 after a fresh toner is supplied to the collected developer (this developer is hereinafter sometimes referred to as a recovered developer). Therefore, even when the recovered developer has a proper toner concentration, problems in that uneven density images or low density images are produced occur. This is because the recovered developer (i.e., the mixture of the collected developer and the fresh toner) is not sufficiently agitated. The problems are remarkably caused when the collected developer has been used for developing images having a high image area proportion. In FIG. 2, numerals 8, 6 and 209 denote first, second and third augers, and numerals 15*c* and 16R denote a center of the developing roller 5 and a developer thickness controlling member for controlling the thickness of the developer on the developing roller 5.

The background developing device proposed by JP-A 11-167260 is illustrated in FIG. 3. In a background developing device 4*c* illustrated in FIG. 3, a developer supplying passage 9 for supplying a developer to a developing roller 5 is separated from a developer collecting passage 7 for collecting the developer passing through the development region at which the developing roller 5 is opposed to an electrostatic latent image bearing member 1. The developing device 4*c* further includes a developer agitating passage 10 for agitating the developer, which is fed to the downmost stream side of the developer supplying passage 9, and the collected developer, which is fed to the downmost stream side of the developer collecting passage 7, while feeding the mixed developer in the direction opposite to the developer feeding direction in the developer supplying passage 9.

In the developing device 4*c*, the collected developer is fed to the developer collecting passage 7, and therefore the collected developer is not mixed with the developer in the developer supplying passage 9. Therefore, the toner concentration of the developer in the developer supplying passage 9 (i.e., the toner concentration of the developer fed to the developing roller 5) hardly changes.

In the developing device 4*c*, the collected developer is mixed with the developer fed through the developer supplying passage 9 without being used for development, followed by agitating in the developer agitating passage 10. The thus mixed developer is supplied to the developer supplying passage 9. Therefore, the above-mentioned problems in that uneven density images or low density images are produced are hardly caused.

However, in the developing device 4*c*, the developer is not directly returned from the development region to developer supplying passage 9. Therefore, in order to stably feed the developer toward the downstream side of the developer supplying passage 9, the speed of feeding the developer through the developer supplying passage 9 has to be faster than the speed of feeding the developer to the development region. In this case, a high stress is applied to the developer in the developer supplying passage 9, resulting in acceleration of deterioration of the carrier in the developer, thereby shortening the life of the developer. In FIG. 3, numerals 404 and 405 denote partitions, and numeral 27*c* denotes a toner concentration sensor for detecting the toner concentration of the developer.

In developing operations of general developing device 5 using a two component developer, the toner is consumed while the carrier is not consumed and stays in the developing device. Therefore, the carrier, which is agitated together with the toner in the developing device, deteriorates as the frequency of agitation (or agitation time) increases. This is because the resin layer formed on the surface of the carrier is peeled or the toner is adhered to the resin layer, resulting in deterioration of the resistivity of the carrier and charging property of the developer. In this case, the developing property of the developer changes (so as to be excessively enhanced), thereby causing problems in that the image density increases and the background of images is developed with the toner (i.e., background development occurs).

In attempting to solve the problem, JP-A59-100471 proposes a trickle developing method in that a mixture of a toner and a carrier is added to compensate the toner used for development while replacing the carrier little by little in the developing device. However, even in such a developing device, the amount of deteriorated carrier particles increases after long repeated use. Therefore, it is difficult for the developing device to prevent occurrence of the problems in that the image density increases and the background of images is developed with the toner.

JP-A 03-145678 discloses a technology in that a developer supplement, which includes a toner and a carrier having a higher resistance than the carrier in the developing device, is supplied to the developing device in attempting to maintain the charging property of the developer, resulting in prevention of deterioration of image qualities.

In addition, JP-A 11-223960 (corresponding to U.S. Pat. No. 6,096,466) discloses a technology in that a developer supplement, which includes a toner and a carrier capable of imparting a larger amount of charge quantity to the toner than the carrier in the developing device, is supplied to the developing device in attempting to maintain the charging property of the developer, resulting in prevention of deterioration of image qualities.

However, the technologies proposed by JP-As 03-145678 and 11-223960 have a drawback in that the amount of the supplementary carrier replaced with the carrier in the developer changes depending on the amount of toner consumed for development, thereby changing the resistance and charging quantity of the developer in the developing device, resulting in variation of image density.

JP-A 08-234550 discloses a technology in that plural kinds of developer supplements, which are contained in a container while forming layers and each of which includes a toner and a carrier, wherein each of the carriers therein is different in property from the carrier in the developing device, are supplied to the developing device one by one. However, the technology has a drawback in that it is difficult to supply the plural kinds of developer supplements (contained in a container) without mixing the developer supplements. In addition, since the toner is contained in each of the developer supplements at a higher concentration than that in the developer in the developing device, the carrier tends to easily deteriorate. Therefore, it is hard for the developer to stably produce high quality images for a long period of time.

In addition, it is described in JP-A 08-234550 that the amount of silicone resin layer formed on the core particles of the supplementary carriers is increased to increase the resistance of the supplementary carriers. In this case, although the resistance of the coated carrier can be increased, the charging quantity of the carrier decreases, resulting in deterioration of reproducibility of the developed images and/or occurrence of the background development problem.

Therefore, it is necessary for the above-mentioned trickle development methods (i.e., the technologies using a developer supplement) that the carrier in the developer supplement can stably maintain a good charge imparting property even when used for a long period of time, in order that the developer in the developing device maintains a good developing property.

Two component developers typically use a coated carrier to prevent formation of a film of toner on the carrier; to form a uniform surface on the carrier; to prevent the surface of the carrier from being oxidized; to improve the humidity resistance of the carrier; to prolong the life of the developer; to prevent the image bearing member (such as photoreceptors) from being scratched or abraded by the carrier; and to control the charging properties (such as polarity and charge quantity). For example, JP-A 58-108548 discloses a carrier covered with a resin, and JP-As 57-168255, 58-117555 and 06-202381 have disclosed carriers covered with a resin layer including an additive.

JP-A 05-273789 discloses a technology in that an additive is adhered to the surface of a carrier. JP-A 09-160304 discloses a technology in that an electroconductive particulate material having a larger diameter than the thickness of the cover layer of the carrier is included in the cover layer.

In addition, JP-A 08-6307 discloses to use a benzoguanamine/n-butylalcohol/formaldehyde copolymer for the cover layer of the carrier. Further, JP-A 02-79862 discloses to use a crosslinked material of a melamine resin and an acrylic resin for the cover layer of the carrier.

These proposals for enhancing the durability of the cover layer of the carrier are effective for the developer supplements mentioned above for use in the trickle developing methods because the developers can maintain a good charge imparting ability for a long period of time. However, the needs for durability of developer become severer and severer. Therefore, the needs for durability cannot be satisfied only by using such coated carriers. Specifically, occurrence of a spent toner problem in that the toner used is adhered to the surface of the carrier, deterioration of charging property of the developer due to the spent toner problem, and the background development problem cannot be fully solved by these technologies.

In addition, the trickle development methods have another drawback in that when a developer supplement including a toner and a carrier having a poor fluidity is supplied, the developer has a poor feeding property, resulting in occurrence of a feeding problem in that the developer is unevenly fed in the developing device.

Because of these reasons, a need exists for an image forming apparatus which hardly deteriorates the developer even when the developer feeding speed is increased, and hardly causes the above-mentioned problems even when a trickle development method is used.

SUMMARY OF THE INVENTION

As an aspect of the present invention, an image forming apparatus is provided, which includes:

an image bearing member configured to bear an electrostatic latent image thereon;

a developing device, which is configured to develop the electrostatic latent image with a developer including a toner and a carrier to form a toner image on the image bearing member and which includes:

- a developer bearing member configured to bear the developer to develop the electrostatic latent image with the developer at a development region;
- a developer containing portion configured to contain the developer therein;
- a developer supplying passage including a developer feeding member configured to feed the developer in a first direction parallel to an axial direction of the developer bearing member to supply the developer to the developer bearing member; and
- a developer agitating passage including a developer agitating member configured to feed a mixture of the developer, which is fed to a downmost stream side of the developer supplying passage without being used for developing the electrostatic latent image, and the developer, which passes through the development region and is directly returned to the developer agitating passage, in a second direction opposite to the first direction to the upstream side of the developer supplying passage while agitating the mixed developer, wherein the developer agitating passage is separated with a partition from the developer supplying passage except for at least both end portions thereof in the first and second directions;

a developer supplement supplying device configured to supply a developer supplement including the toner and the carrier to the developing device to mix the developer supplement with the mixed developer; and a developer discharging device configured to discharge an excess of the developer from the developing device to replace at least a part of the carrier in the developer with the carrier in the developer supplement.

The carrier includes a particulate core material and a cover layer located on the surface of the particulate core material, and the cover layer includes a binder resin and a first particulate material, wherein the cover layer satisfies the following relationship:

$$1<(D1/h)<10,$$

wherein D1 represents the volume average particle diameter of the first particulate material in units of micrometer, and h represents the average thickness of a resinous portion of the cover layer in units of micrometer.

The developer containing portion of the developing device can optionally include a developer collecting passage configured to collect the developer, which passes through the development region, to feed the collected developer toward the downmost stream side thereof in the first direction so that the mixture of the collected developer and the developer fed to the downmost stream side of the developer supplying passage without use for developing is agitated and fed by the developer agitating passage in the second direction. In this case, the developer supplying passage, the developer collecting passage, and the developer agitating passage are separated with a partition from each other (for example, except for at least both the end portions of the developer supplying passage and the developer agitating passage and a portion of the developer collecting passage in the first and second directions), and the developer supplying passage is located over the developer collecting passage and the developer agitating passage while the developer collecting passage and the developer agitating passage are located on substantially the same level.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
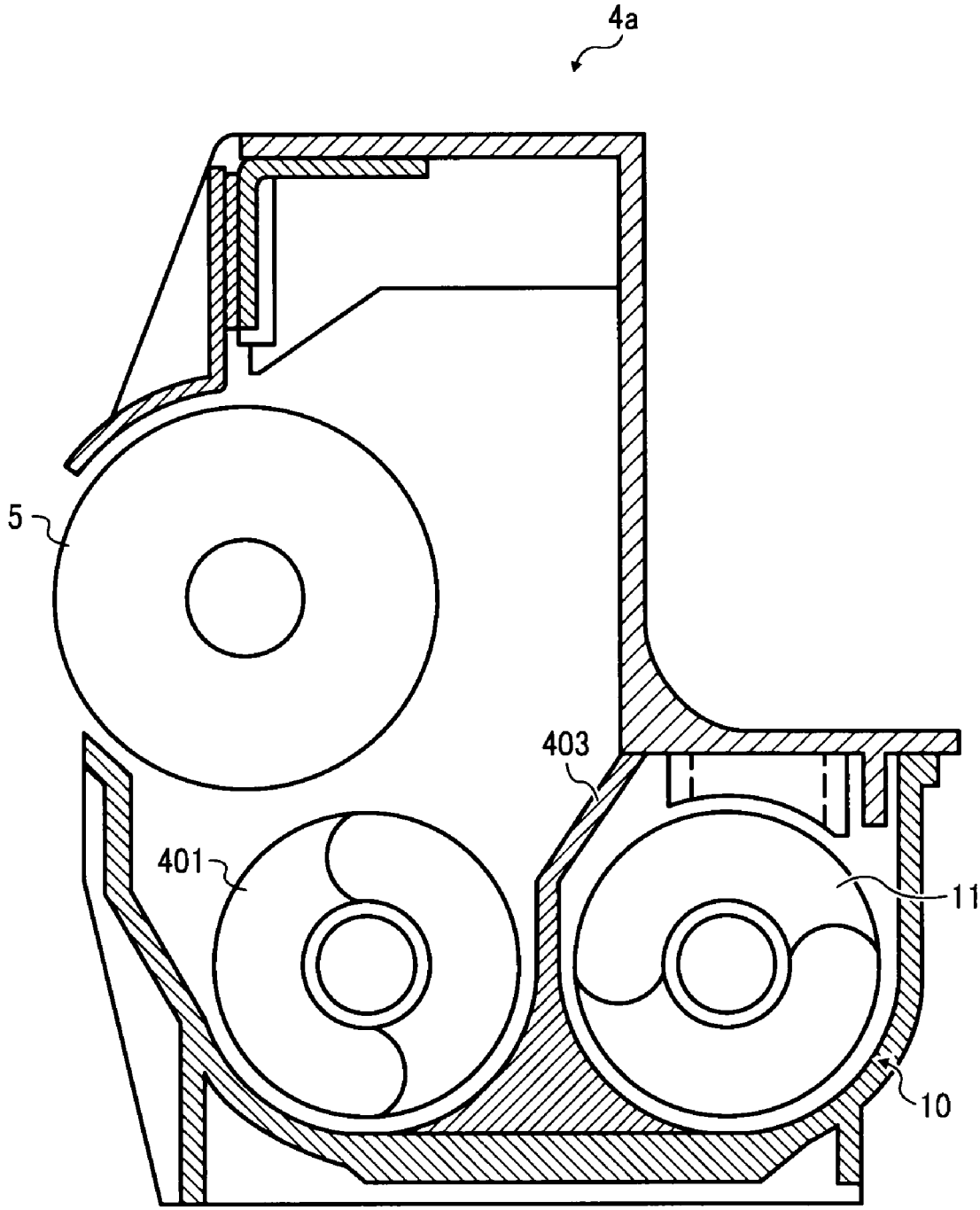
FIG. 1 BACKGROUND ART
FIGS. 1-3 are cross-sectional schematic views illustrating background developing devices.

The image forming apparatus of the present invention includes:

an image bearing member configured to bear an electrostatic latent image thereon;

a developing device, which is configured to develop the electrostatic latent image with a developer including a toner and a carrier to form a toner image on the image bearing member and which includes:

a developer bearing member configured to bear the developer to develop the electrostatic latent image with the developer at a development region;

a developer containing portion configured to contain the developer therein;

a developer supplying passage including a developer feeding member configured to feed the developer in a first direction parallel to an axial direction of the developer bearing member to supply the developer to the developer bearing member; and a developer agitating passage including a developer agitating member configured to feed a mixture of the developer, which is fed to a downmost stream side of the developer supplying passage without being used for developing the electrostatic latent image, and the developer, which passes through the development region and is directly returned to the developer agitating passage without passing through the developer supplying passage, in a second direction opposite to the first direction to the upstream side of the developer supplying passage while agitating the mixed developer, wherein the developer agitating passage is separated with a partition from the developer supplying passage except for at least both end portions thereof in the first and second directions;

a developer supplement supplying device configured to supply a developer supplement including the toner and the carrier to the developing device to mix the developer supplement with the mixed developer; and a developer discharging device configured to discharge an excess of the developer from the developing device to replace at least a part of the carrier in the developer with the carrier in the developer supplement.

The carrier includes a particulate core material and a cover layer located on the surface of the particulate core material, and the cover layer includes a binder resin and a first particulate material, wherein the cover layer satisfies the following relationship:

$$1<(D1/h)<10,$$

wherein D1 represents the volume average particle diameter of the first particulate material in units of micrometer, and h represents the average thickness of a resinous portion of the cover layer in units of micrometer.

The developing device can optionally include a developer collecting passage configured to collect the developer, which passes through the development region, to feed the collected developer toward the downmost stream side thereof in the first direction so that the mixture of the collected developer and the developer fed to the downmost stream side of the developer supplying passage without use for developing is agitated and fed by the developer agitating passage in the second direction. In this case, the developer supplying passage, the developer collecting passage, and the developer agitating passage are separated with a partition from each other, and the developer supplying passage is located over the developer collecting passage and the developer agitating passage while the developer collecting passage and the developer agitating passage are located on substantially the same level. In this regard, the developer supplying passage, the developer collecting passage, and the developer agitating passage are communicated, for example, at least both end portions of the developer supplying passage and the developer agitating passage and a portion of the developer collecting passage in the first and second directions.

The image forming method of the present invention includes:

forming an electrostatic image on an image bearing member;

feeding a two component developer including a toner and a carrier in a first direction in a developer supplying passage while supplying the developer to a developer bearing member;

developing the electrostatic image with the developer supplied to the developer bearing member at a development region to form a toner image on the image bearing member;

feeding the developer passing through the development region to a developer agitating passage, which is separated from the developer supplying passage (for example, except for at least both the end portions thereof);

mixing the developer passing through the development region and returned to the developer agitating passage without passing through the developer supplying passage, and the developer fed to a downmost stream side of the developer supplying passage without being used for developing while feeding the mixed developer in a second direction opposite to the first direction;

supplying a developer supplement including the toner and the carrier to mix the developer supplement with the mixed developer while discharging an excess of the developer to replace at least a part of the carrier in the developer with the carrier in the developer supplement; and supplying the mixture of the developer supplement and the mixed developer to the developer supplying passage, wherein the carrier includes a particulate core material and a cover layer located on the surface of the particulate core material, and wherein the cover layer includes a binder resin and a first particulate material, wherein the cover layer satisfies the following relationship:

$$1<(D1/h)<10,$$

wherein D1 represents the volume average particle diameter of the first particulate material in units of micrometer, and h represents the average thickness of a resinous portion of the cover layer in units of micrometer.

In addition, the developer of the present invention includes:

a toner including a binder resin and a colorant; and a carrier including a particulate core material and a cover layer located on a surface of the particulate core material, wherein the cover layer includes a binder resin and a first particulate material, and wherein the cover layer satisfies the following relationship:

$$1<(D1/h)<10,$$

wherein D1 represents the volume average particle diameter of the first particulate material in units of micrometer, and h represents the average thickness of a resinous portion of the cover layer in units of micrometer.

Further, a process cartridge of the present invention is detachably attached to an image forming apparatus as a unit. The process cartridge includes:

an image bearing member configured to bear an electrostatic latent image thereon; and a developing device, which is configured to develop the electrostatic latent image with a developer including a toner and a carrier to form a toner image on the image bearing member and which includes:

a developer bearing member configured to bear the developer to develop the electrostatic latent image with the developer at a development region;

a developer supplying passage including a developer feeding member configured to feed the developer in a first direction parallel to an axial direction of the developer bearing member to supply the developer to the developer bearing member; and a developer agitating passage including a developer agitating member configured to feed a mixture of the developer, which is fed to a downmost stream side of the developer supplying passage without being used for developing the electrostatic latent image, and the developer, which passes through the development region and is directly returned to the developer agitating passage, in a second direction opposite to the first direction to an upstream side of the developer supplying passage, wherein the developer agitating passage is separated with a partition from the developer supplying passage except for at least both the end portions thereof in the first and second directions, wherein the developer containing portion receives a developer supplement including the toner and the carrier while an excess of the developer is discharged by the image forming apparatus from the developing device to replace at least a part of the carrier in the developer with the carrier in the developer supplement, and wherein the carrier includes a particulate core material and a cover layer located on the surface of the particulate core material, and wherein the cover layer includes a binder resin and a first particulate material, wherein the cover layer satisfies the following relationship:

$$1<(D1/h)<10,$$

wherein D1 represents the volume average particle diameter of the first particulate material in units of micrometer, and h represents the average thickness of a resinous portion of the cover layer in units of micrometer.

Similarly to the image forming apparatus of the present invention, the process cartridge can optionally include a developer collecting passage configured to collect the developer, which passes through the development region, to feed the collected developer toward the downmost stream side thereof in the first direction so that the mixture of the collected developer and the developer fed to the downmost stream side of the developer supplying passage without use for developing is agitated and fed by the developer agitating passage in the second direction. In this case, the developer supplying passage, the developer collecting passage, and the developer agitating passage are separated with a partition from each, and the developer supplying passage is located over the developer collecting passage and the developer agitating passage while the developer collecting passage and the developer agitating passage are located on substantially the same level. In this regard, the developer supplying passage, the developer collecting passage, and the developer agitating passage are communicated, for example, at least both the end portions of the developer supplying passage and the developer agitating passage and a portion of the developer collecting passage in the first and second directions.

The present invention will be explained in detail.

As a result of the study of the present inventors for solving the above-mentioned problems, the following knowledge is attained:

(1) By using a developing device having a developer supplying passage and a developer agitating passage (and an optional developer collecting passage), the image density problem in that uneven density images are formed or low density images are formed is hardly caused;

(2) By using a development method in which a developer supplement including a toner and a carrier is supplied to the developing device while the excess developer is discharged from the developing device, change in charge quantity of the developer is controlled, thereby stabilizing the image density of copies; and (3) By using a coated carrier, which satisfies the above-mentioned relationship, ($1<D1/h<10$), for the developer, the developer is durable sufficient to endure the stress applied when the developer is fed at a high speed in the developer supplying passage, and therefore the developer can maintain good charge imparting ability and fluidity, resulting in formation of high quality images for a long period of time.

As mentioned above, the developing device for use in the image forming apparatus of the present invention includes at least a developer supplying passage having a developer supplying member (first feeding member), and a developer agitating passage having a developer agitating and feeding member (second feeding member). Hereinafter, this developing device is sometimes referred to as a two-passage one-way circulation developing device. The developing device can further include a developer collecting passage having a collecting and feeding member (third feeding member) in addition to the developer supplying passage and the developer agitating passage. Hereinafter, this developing device is sometimes referred to as a three-passage one-way circulation developing device.

In either case, the developer fed by the developer supplying member and passing through the development region is not returned to the developer supplying passage, and is returned to the developer agitating passage directly or through the developer collecting passage. After being agitated in the developer agitating passage, the developer is fed to the developer supplying passage. Hereinafter, this developing method is sometimes referred to as a one-way circulation developing method.

The two-passage one-way circulation developing device includes no developer collecting passage, and the developer passing through the development region is directly fed to the developer agitating passage. In contrast, in the three-passage one-way circulation developing device, the developer passing through the development region is fed to the developer collecting passage, and the collected developer is then fed to the developer agitating passage. Thus, the developer passing through the development region is not directly fed to the developer supplying passage. The developer (i.e., collected developer) fed to the developer agitating passage is mixed thereat with the developer (i.e., unused developer), which is fed through the developer supplying passage without use for developing. The mixed and agitated developer is then fed to the developer supplying passage.

The difference between the two-passage one-way circulation developing device and the three-passage one-way circulation developing device will be clearly understood from comparison of Example 13 with Example 1 below.

The two-passage one-way circulation developing device has an advantage such that the developer supplement (toner or premix toner including a toner and a carrier) supplied thereto is rapidly dispersed in the developer in the developing device.

When a toner (developer supplement) is supplied to the developer circulated in a developing device, the toner is not evenly dispersed, i.e., the developer includes a portion including the toner at a high concentration, and a potion including the toner at a low concentration, just after the toner is added. In order to avoid the problem, the added toner has to be dispersed in the entire developer in the developing device.

Figure 9:
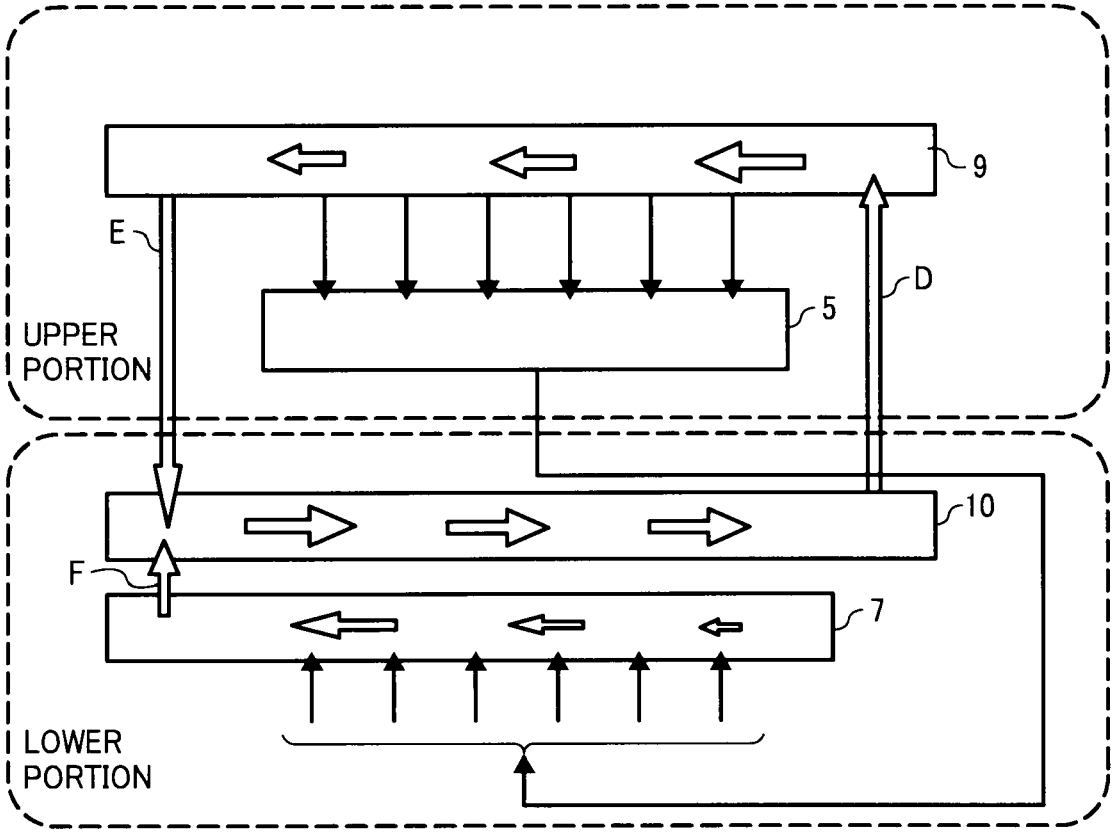
FIG. 9 is a schematic view for explaining how the developer flows in the developing device.
Figure 19:
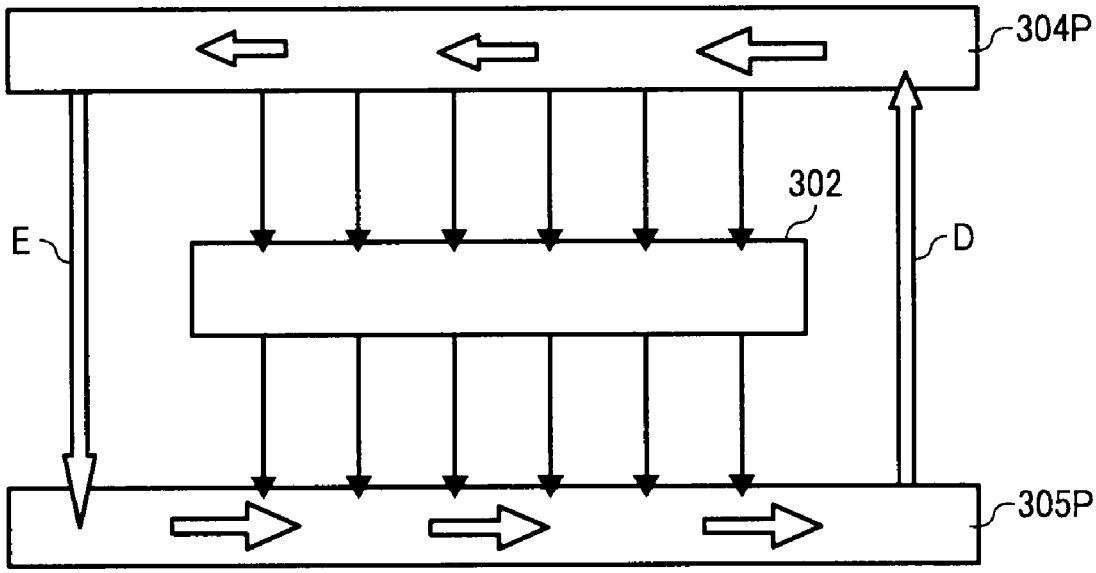
FIG. 19 is a schematic view for explaining how the developer flows in the developing device illustrated in FIG. 16.

In conventional developing devices which have only a developer supplying passage and a developer agitating passage and which has such a structure as illustrated in FIG. 1, the developer used for developing is used again in a downstream side of the developer supplying passage. Therefore, uneven density images tend to be formed. In three-passage one-way circulation developing devices, the developer used for developing (i.e., the collected developer) is mixed with the developer fed to the downmost stream side of the developer supplying passage without use for developing at a junction between the developer supplying passage and the developer collecting passage (as illustrated in FIG. 9 below). In contrast, in two-passage one-way circulation developing devices, the developer passing through the development region is mixed with the developer fed to the downmost stream side of the developer supplying passage without use for developing in the entire portion of the developer agitating passage (i.e., the length of the developer mixing area is relatively longer than that in the three-passage one-way circulation developing devices as illustrated in FIG. 19 below). Therefore, the developer passing through the development region and the developer, which is not used for developing, can be well mixed, and thereby occurrence of the uneven density image problem can be prevented.

In addition, the two-passage one-way circulation developing device includes no developer collecting passage, and therefore the developing device can be miniaturized.

Figure 4:
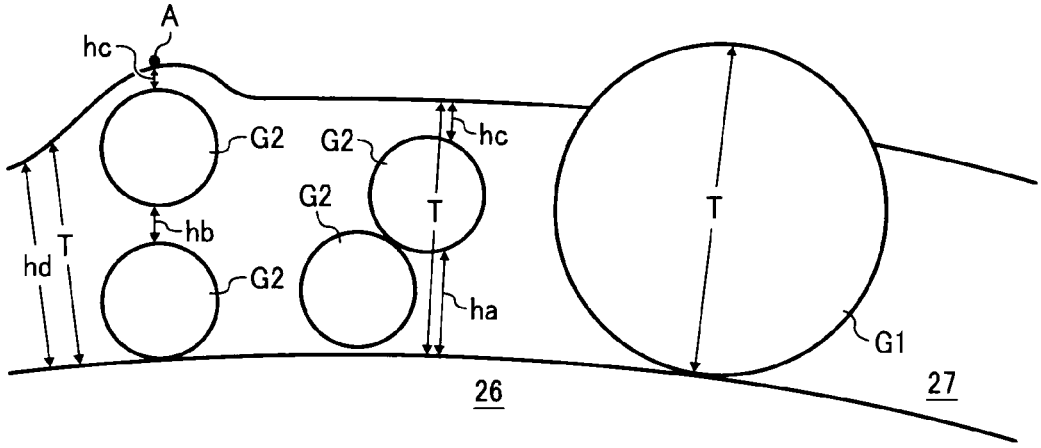
FIG. 4 is a schematic cross-sectional view illustrating a cover layer of a carrier included in a developer for use in an image forming apparatus of the present invention.

FIG. 4 illustrates the cover layer of the carrier for use in the developer used for the image forming apparatus of the present invention. The carrier includes a core material 26 and a cover layer 27 covering the core material 26. The cover layer 27 includes at least a binder resin and a hard particulate material (hereinafter sometimes referred to as a first particulate material G1). The ratio (D1/h) of the particle diameter (D1 μm) of the first particulate material G1 to the average thickness (h μm) of the resinous portion of the cover layer 27 is preferably greater than 1 and less than 10.

The carrier can have one or more other layers than the cover layer 27. In addition, the cover layer 27 can include other components such as second particulate materials (explained later) and additives.

The average thickness of the resinous portion of the cover layer 27 represents the average of the thicknesses of the resinous portions (except the thickness of particulate materials) in the radial direction of the carrier. Specifically, as illustrated in FIG. 4, the thicknesses of resinous portions include a thickness ha of a resinous portion between the surface of the core material 26 and the lower surface of a particle present in the cover layer 27, a thickness hb of a resinous portion present between two particles, a thickness hc of a resinous portion present between the upper surface of a particle and the upper surface of the cover layer 27, and a thickness hd of a resinous portion including no particle.

The method for determining the average thickness h of the resinous portion of the cover layer 27 is as follows. Specifically, the cross section of a carrier particle having a cover layer 27 is observed with a transmission electron microscope. Then the thicknesses (ha, hb, hc or hd) of the cover layer are measured at regular intervals of 0.2 μm along the surface of the carrier. The average thickness h of the resinous portion is determined by averaging the 50 thickness data thus obtained. In this regard, each data for any one of the thicknesses ha, hb, hc, and hd is counted as one data. Specifically, in FIG. 4, the thickness data hb and hc at a point A are counted as two data. If the fiftieth data is plural data (data of n pieces) (such as hb and hc at a point A in FIG. 4), the total of the thickness data are divided by (49+n)).

This thickness measurement is performed on randomly selected five (or more) carrier particles. If each of the average thicknesses (T1-T5) of the resinous portions of the randomly selected five particles are within a range of from 0.85 Tave to 1.15 Tave (Tave is the average of the thicknesses T1-T5), the average thickness Tave is used as the average thickness h of the resinous portion. In this case, if the average thicknesses of the resinous portion of N carrier particles are out of the range and the average thickness of the residual (5−N) carrier particles are within the range, the data of the N carrier particles are excluded from calculation. Next, the thickness measurement is performed on newly selected N carrier particles and the residual (5−N) carrier particles to determine whether all the average thicknesses (T1-T5) of the resinous portions of the carrier particles are within a range of from 0.85 Tave to 1.15 Tave. This operation is repeated until all the average thicknesses (T1-T5) of the resinous portions of the carrier particles fall within a range of from 0.85 Tave to 1.15 Tave. Even when the measurement is performed on 12 carrier particles (in total) but all the average thickness h cannot be determined, the average thickness h is determined as the average Tave of the 10 carrier particles having smaller deviations from the average thickness Tave among the 12 carrier particles.

As mentioned above, the volume average particle diameter D1 of the first particulate material G1 is preferably greater than the average thickness h of the resinous portion of the cover layer 27, and less than 10h (i.e., $1<D1/h<10$). More preferably, the volume average particle diameter D1 is less than 5h (i.e., $1<D1/h<5$).

When the above-mentioned relationship is satisfied, the first particulate material G1 projects from the surface of the cover layer 27. When the developer including toner particles and carrier particles is agitated in the developing device to charge the toner particles, the carrier particles are contacted with the toner particles and other carrier particles through the projections (i.e., carrier particles make point contact), and thereby the carrier particles are prevented from receiving strong impact, resulting in prevention of peeling of the cover layer 27 of the carrier particles.

In addition, since the carrier particles make point contact as mentioned above, the carrier has good fluidity. Therefore, the developer has good feeding property, and thereby the developer can be well fed in the developer supplying passage without uneven transportation, resulting in formation of images with even image density. Further, the carrier particles are contacted with each other through the projections, the toner adhered to the surface of the carrier particles can be scraped off by the projections, i.e., the surface of the carrier particles can be well cleaned. Therefore, occurrence of the spent toner problem can be prevented.

When the ratio D1/h is not greater than 1, the first particulate material G1 tends to be buried in the binder resin layer, and thereby the above-mentioned effect of the first particulate material G1 cannot be well produced. In contrast, when the ratio D1/h is not less than 10, the area of the surface of the first particulate material G1 contacted with the binder resin seriously decreases, and thereby the first particulate material G1 is easily released from the surface of the carrier particles.

The cover layer 27 preferably includes another hard particulate material (i.e., a second particulate material G2) in order to impart good mechanical strength to the entire cover layer 27. The second particulate material G2 preferably satisfies the following relationships:

$0.001<D2/h<1$, and preferably, $0.01<D2/h<0.5$, wherein D2 represents the volume average particle diameter of the second particulate material G2, and h represents the average thickness of the resinous portion of the cover layer 27.

Since the volume average particle diameter (D2) of the second particulate material G2 is smaller than the average thickness h of the resinous portion, the second particulate material G2 is dispersed while buried in the binder resin layer, and thereby the strength of the entire cover layer 27 can be averagely enhanced.

When the ratio D2/h is not less than 1, the diameter of the second particulate material G2 is much greater than the thickness of the cover layer 27. Therefore, the effect of the second particulate material G2 of enhancing the strength of the cover layer 27 is hardly produced. In contrast, when the ratio D2/h is not greater than 0.001, the diameter of the second particulate material G2 is much smaller than the thickness of the cover layer 27. Therefore, the effect of the second particulate material G2 of enhancing the strength of the cover layer 27 is hardly produced.

In addition, the second particulate material G2 preferably has a volume resistivity of not greater than $1.0\times10^{12}$ Ω·cm, more preferably not greater than $1.0\times10^{10}$ Ω·cm, and even more preferably not greater than $1.0\times10^{8}$ Ω·cm. When the second particulate material G2 has such a relatively low volume resistivity, the charge imparting ability of the cover layer 27 is controlled so as to be proper (i.e., relatively low), and thereby the image density of copies can be enhanced.

The volume resistivity of such a particulate material (first and second particulate materials) can be determined by the following method.

A sample is contained in a cylindrical polyvinyl chloride tube having an inside diameter of 1 inch (2.54 cm). Each of the upper and lower surfaces of the sample is connected with an electrode. A pressure of 15 kg/cm$^2$ (i.e., $1.47\times10^6$ Pa) is applied for 1 minute to the electrodes using a pressing machine. The resistance of the sample is measured with a LCR meter while the pressure is applied thereto. The volume resistivity of the sample is calculated from the thus determined resistance (r) using the following equation (1):

$$\text{Volume resistivity } (\Omega\cdot\text{cm})=(2.54/2)^2\times(\pi/H\times r) \quad (1)$$

wherein H represents the thickness of the sample, and r represents the measured resistance of the sample.

In FIG. 4, T represents the thickness of the cover layer 27. The average of the thickness (T) of the cover layer 27 is preferably from 0.1 μm to 3.0 μm, and more preferably from 0.1 μm to 2.0 μm. When the average thickness T of the cover layer 27 is less than 0.1 μm, a problem in that the cover layer 27 is abraded and thereby the core material 26 is exposed, resulting in shortening of the life of the carrier. In contrast, when the average thickness T is greater than 3.0 μm, the carrier tends to have a small magnetization intensity, and thereby a carrier adhesion problem in that carrier particles are attracted by an electrostatic latent image on the image bearing member as well as toner particles, resulting in formation of an image constituted of the toner particles and carrier particles.

The average thickness (h) of the resinous portion of the cover layer 27 is preferably from 0.04 μm to 2 μm, and more preferably from 0.04 μm to 1 μm.

The particle diameter D1 (volume average particle diameter) of the first particulate material G1 is preferably from 0.05 μm to 3 μm, and more preferably from 0.05 μm to 1 μm.

The particle diameter D2 (volume average particle diameter) of the second particulate material G2 is preferably from 0.005 μm to 1 μm, and more preferably from 0.01 μm to 0.2 μm.

The volume average particle diameter of the first and second particulate materials G1 and G2 is determined by the following method.

At first, 30 ml of an aminosilane coupling agent (SH6020 from Dow Corning Toray Silicone Co., Ltd., and 300 ml of toluene are fed into a juicing blender, and then 6.0 g of a sample is fed thereinto. The mixture is agitated by the juicing blender for 3 minutes while the rotation speed dial is set to "low" to prepare a dispersion. Next, a proper amount of the thus prepared dispersion is mixed with 500 ml of toluene in a 1-liter beaker to be diluted. The diluted dispersion is always agitated with a homogenizer until the measurement operation is completed. Next, the volume average particle diameter of the sample in the diluted dispersion is measured with a super centrifugal automatic particle diameter distribution measuring instrument, CAPA-700 from Horiba Ltd. The measuring conditions are as follows.

Rotation speed: 2,000 rpm

Measurable minimum particle diameter: 0.1 μm

Measurable maximum particle diameter: 2.0 μm

Interval of particle diameter (i.e., width of one particle diameter range): 0.1 μm Viscosity of dispersing medium: 0.59 mPa·s Density of dispersing medium: 0.87 g/cm$^3$ Density of particle: Data of the true specific gravity of the sample, which is determined using a dry automatic bulk density measuring instrument, MICROMERITICS GAS PYCNOMETER ACCUPYC 1330 from Shimadzu Corp., is input to CAPA-700.

As can be understood from FIG. 4, the thickness T of the cover layer 27 is different from the average thickness h of the resinous portion of the cover layer 27, and means the distance of from the surface of the core material 26 to the surface of the cover layer 27. When the particle diameter D1 of the first particulate material G1 is greater than the thickness of the resinous portion of the cover layer 27, the thickness T of the portion of the cover layer 27 is equal to the diameter D1. The thickness T and the average thickness of the cover layer 27 can also be determined by the method using a transmission electron microscope, which is mentioned above for use in determining the average thickness h of the resinous portion of the cover layer 27.

Specific examples of the first particulate material G1 include hard particulate materials such as particles of alumina, silica, titania, and zinc oxide. Among these materials, particulate alumina is preferably used because of having good compatibility with binder resins; good dispersibility and adhesiveness; and high hardness. Namely, a particulate alumina in the cover layer 27 is hardly abraded or cracked even when a large stress is applied thereto in the developing device. Accordingly, the cover layer 27 can be well protected for a long period of time while removing the spent toner adhered to the surface of the carrier.

Among various particulate alumina, untreated or treated particulate alumina having a volume average particle diameter of not greater than 3 μm are preferably used. Specific examples of treated particulate alumina include alumina whose surface is subjected to a hydrophobizing treatment or the like.

Untreated or treated silica can also be preferably used. Specific examples of treated particulate silica include silica whose surface is subjected to a hydrophobizing treatment or the like.

The content of the first particulate material G1 in the cover layer 27 is preferably from 10% to 80% by weight, and more preferably from 20% to 60% by weight, based on the total weight of the cover layer 27. When the content is too low, the effect of the first particulate material G1 of decreasing the impact applied to the binder resin in the cover layer 27 cannot be well produced, and thereby good durability cannot be imparted to the carrier. In contrast, when the content is too high, the effect of the binder resin of imparting charges to the toner cannot be well produced. In addition, the first particulate material is easily released from the cover layer 27, and thereby the charge quantity and resistance of the carrier change, resulting in change of image qualities (i.e., shortening of the life of the carrier).

The content of the first particulate material G1 in the cover layer 27 is represented by the following equation (2):

$$\text{Content of } G1\,(\text{wt }\%)=(Wg1/Wt)\times 100 \quad (2)$$

wherein Wg1 represents the weight of the first particulate material G1, and Wt represents the total weight of the cover layer 27 (i.e., the total weight of the first and second particulate materials G1 and G2, the binder resin, and other components included in the cover layer 27).

Specific examples of the second particulate material G2 include particles of titanium oxide, zinc oxide, tin oxide, and the like, which may be subjected to a surface treatment. These materials have good compatibility with binder resins; good dispersibility and adhesiveness; and high hardness. Among these materials, titanium oxide subjected to a surface treatment is preferably used as the second particulate material G2.

The second particulate material G2 is not limited to the above-mentioned materials. For example, any particulate materials which are subjected to a surface treatment (such as hydrophobizing treatments) to enhance the dispersibility in binder resins and/or which are subjected to a surface treatment (such as electroconducting treatments) to control the particle diameter and/or the volume resistivity can produce the same effects.

The content of the second particulate material G2 in the cover layer 27 is preferably from 2% to 50% by weight, and more preferably from 2% to 30% by weight. Although as the content of the second particulate material G2 increases, the strength of the cover layer 27 is enhanced. However, when the content of the second particulate material G2 is too high, the particulate material is poorly dispersed in the cover layer 27 (i.e., the particulate material aggregates in the cover layer 27), and thereby the effects of the second particulate material G2 cannot be well produced. In addition, when the content is too low, the effects of the second particulate material G2 cannot be well produced.

The content of the second particulate material G2 in the cover layer 27 is represented by the following equation (3):

$$\text{Content of } G2(\text{wt }\%)=(Wg2/Wt)\times 100 \quad (3)$$

wherein Wg2 represents the weight of the second particulate material G2, and Wt represents the total weight of the cover layer 27 (i.e., the total weight of the first and second particulate materials G1 and G2, the binder resin, and other components included in the cover layer 27).

Specific examples of the binder resin in the cover layer 27 include reaction products of an acrylic resin and an amino resin, silicone resins, and the like.

Among the reaction products of an acrylic resin and an amino resin, crosslinked materials of an acrylic resin and an amino resin are preferably used. Acrylic resins used for the reaction products are not particularly limited, but acrylic resins having a glass transition temperature (Tg) of from 20° C. to 100° C., and preferably from 25° C. to 80° C., are preferably used. Acrylic resins having such a Tg have proper elasticity, so that impact, which is applied to the carrier when the developer is agitated (i.e., the carrier is rubbed with toner particles or other carrier particles) to frictionally charge the toner, is absorbed by the resins. Therefore, the cover layer 27 of the carrier can be used for a long period of time without being damaged.

When the Tg of acrylic resins is too low, the binder resin tends to cause a blocking problem in that the carrier particles are adhered to each other, resulting in formation of blocked carrier particles, i.e., the carrier has poor preservability. Therefore, the carrier cannot be practically used. In contrast, when the Tg is too high, the acrylic resins become hard and brittle. In this case, impact applied to the carrier cannot be well absorbed, thereby causing problems in that the cover layer 27 is abraded and the cover layer 27 is released from the core material 26.

Amino resins used for the reaction products are not particularly limited, and proper amino resins are used depending on the application of the coated carrier. For example, by using a monomer such as guanamine and melamine, the charging ability of the resultant amino resin can be dramatically enhanced.

Suitable silicone resins for use as the binder resin include strait silicones having only organo-siloxane bonds, and silicone resins modified with a resin such as alkyd resins, polyester resins, epoxy resins, acrylic resins, and urethane resins.

Specific examples of the strait silicones include KR271, KR255, and KR152, which are manufactured by Shin-Etsu Chemical Co., Ltd.; SR2400, SR2406, and SR2410, which are manufactured by Dow Corning Toray Silicone Co., Ltd.; and the like. Specific examples of the modified silicone resins include KR206, which is modified with an alkyd resin, KR5208, which is modified with an acrylic resin, ES1001N, which is modified with an epoxy resin, and KR305, which is modified with a urethane resin, all of which are from Shin-Etsu Chemical Co., Ltd.; SR2115 which is modified with an epoxy resin, and SR2110 which is modified with an alkyd resin, all of which are from Dow Corning Toray Silicone Co., Ltd.; and the like. Silicone resins (and copolymers) can be used alone, but additives and components (to be incorporated therein) such as crosslinking agents and charge quantity controlling agents can be used in combination with silicone resins.

Other resins can be used as the binder resin in the cover layer 27. Specific examples thereof include polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-vinylfluoride copolymers, copolymers of tetrafluoroethylene, vinylidenefluoride and other monomers including no fluorine atom, and the like. These resins can be used alone or in combination.

The cover layer 27 can be formed by coating a coating liquid which is prepared, for example, by dispersing a first particulate material G1, and a second particulate material G2 in a solution of a binder resin, on a core material 26 using a coating method, followed by drying and baking. Suitable coating methods include dip coating methods, rolling fluidized bed coating methods, spray coating methods, and the like.

Specific examples of the solvent include toluene, xylene, methyl ethyl ketone, methyl isobutyl ketone, butyl cellosolve acetate, butyl cellosolve, and the like.

The method for baking the coated cover layer is not particularly limited, and external heating methods and internal heating methods can be used. For example, methods using a heating device such as fixed electric furnaces, fluid electric furnaces, rotary electric furnaces, and burner furnaces, and methods using microwave, are preferably used.

The volume average particle diameter of the core material 26 of the carrier is not particularly limited. However, in order to prevent adhesion of the carrier particles to the image bearing member 1 and to prevent scattering of the carrier particles, the volume average particle diameter is preferably not less than 20 μm. In addition, in order to prevent deterioration of image qualities (i.e., to prevent formation of abnormal images such as streak images caused by carrier particles), the volume average particle diameter is preferably not greater than 100 μm. More preferably, the volume average particle diameter is from 20 μm to 60 μm. In this case, the resultant developer can fulfill the recent need for high image quality.

The material of the core material 26 is not particularly limited, and any known materials for use in carriers for electrophotographic developers can be used. Specific examples thereof include ferrite, magnetite, iron, nickel, and the like. When ferrite is used, Mn ferrite, Mn—Mg ferrite, and Mn—Mg—Sr ferrite are preferably used instead of conventionally used Cu—Zn ferrite, in view of environmental protection. Specific examples of the ferrite compounds include MFL-35S and MFL-35SL (from Powdertech Co., Ltd.); DFC-400M, DFC-410M, and SM-350NV (from Dowa Iron Powder Co., Ltd.); and the like.

The carrier for use in the developer of the present invention preferably has a resistivity of from $1\times10^{11}$ to $1\times10^{16}$ Ω·cm, and more preferably from $1\times10^{12}$ to $1\times10^{14}$ Ω·cm. When the resistivity is too low, the carrier adhesion problem is easily caused particularly when the development gap (i.e., the gap between the surface of the image bearing member 1 and the surface of the developing roller 5) is relatively narrow due to charges induced in the carrier. This carrier adhesion problem is seriously caused when the linear speeds of the image bearing member 1 and the developing roller 5 increase and/or when an AC bias is applied as a development bias. In general, carriers for use in color developers (such as Y, M and C developers) typically have a low resistivity because a relatively large amount of toner is adhered to an electrostatic latent image compared to a case where a black toner image is formed.

The developer including such a carrier can produce image with high image density under a condition in which the toner is well charged to have a proper charge quantity.

When the carrier has too high resistivity, charges having the opposite polarity as that of the toner tend to be accumulated in the carrier, resulting in charging of the carrier, thereby causing the carrier adhesion problem.

The method for measuring the resistivity of a carrier is as follows.

Figure 5:
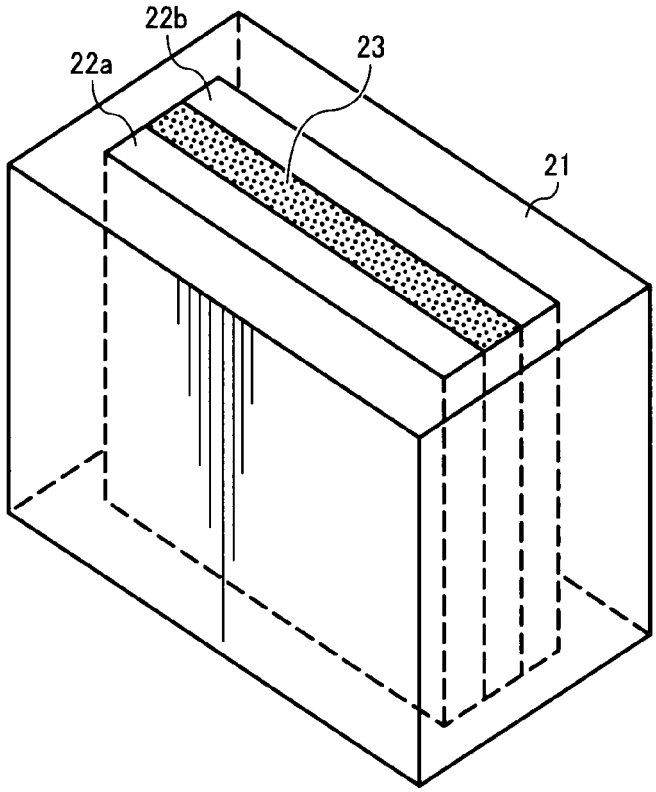
FIG. 5 is a schematic perspective view illustrating a cell of an instrument for measuring the resistivity of a carrier.

At first, a sample (carrier) 23 is contained in a cell 21, which is illustrated in FIG. 5 and which has two electrodes 22*a* and 22*b* each having a surface area of 2 cm×4 cm, wherein the distance between the two electrodes 22*a* and 22*b* is 2 mm. The cell 21 is then tapped 20 times and the upper surface of the cell 21 is scraped once with a plate made of a nonmagnetic material so that the upper surface of the sample 23 in the cell 21 has the same level as the upper surface of the cell 21. In this regard, it is not necessary to press the sample 23. Next, a DC voltage of 100V is applied between the electrodes 22*a* and 22*b*, and the resistivity of the carrier is determined using a high resistance meter 4329A from Yokogawa Hewlett Packard.

The resistivity of the carrier can be adjusted by controlling the resistance and thickness of the cover layer formed thereon. When controlling the resistance of the cover layer, an electroconductive material can be added to the cover layer. Specific examples of such electroconductive materials include metals and metal oxides such as aluminum and zinc oxide; metal oxides (such as aluminum oxide and titanium oxide) subjected to an electroconductive treatment; $SnO_2$, which are prepared by various methods or to which one or more element is doped; boron compounds such as $TiB_2$, $XnB_2$, and $MoB_2$; silicon carbide; electroconductive polymers such as polyacetylene, polyparaphenylene, poly(paraphenylenesulfide), polypyrrole, and polyaniline; carbon blacks such as furnace black, acetylene black, and channel black; and the like.

When a particulate electroconductive material is dispersed in the cover layer, for example, the following method can be used.

Specifically, a particulate electroconductive material is mixed with a solvent used for coating the cover layer or a solution of the binder resin, and the mixture is then subjected to a dispersing treatment using a dispersing machine such as dispersing machines using a medium (e.g., ball mills, and bead mills) and agitators having a blade capable of rotating at a high speed. The thus prepared dispersion is mixed with other components of the cover layer to prepare a cover layer coating liquid.

Next, the image forming apparatus of the present invention will be explained by reference to an example, i.e., a tandem color laser copier (hereinafter referred to as a copier), in which plural photoreceptors (serving as image bearing members) are arranged side by side.

Figure 6:
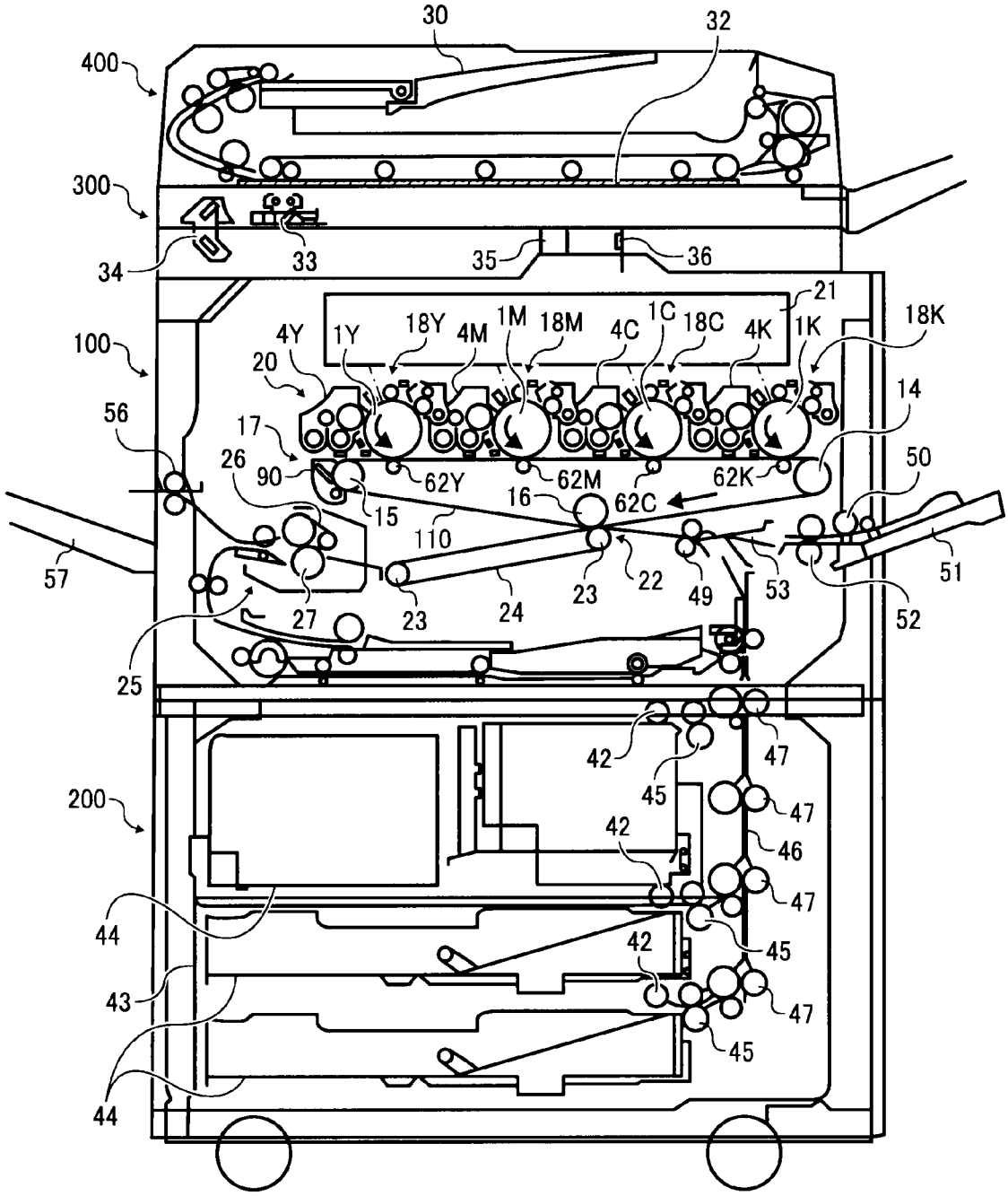
FIG. 6 is a schematic cross-sectional view illustrating an example (copier) of the image forming apparatus of the present invention.

FIG. 6 is a schematic cross-sectional view of the copier. The copier has a printing section 100, a receiving material feeding section 200 on which the printing section 100 is set, a scanner 300 located on the printing section 100, and an automatic document feeder 400 set on the scanner 300.

The printing section 100 includes an image forming unit 20 including four process cartridges 18Y, 18M, 18C and 18K, which respectively form yellow, magenta, cyan and black images. In this regards, a member with a suffix of Y, M, C or K is a member used for forming a yellow, magenta, cyan or black color image, respectively. The suffix is sometimes omitted if it is not necessary for explanation. The printing section 100 further includes an optical image writing unit 21, an intermediate transfer unit 17, a secondary transfer device 22, a pair of registration rollers 49, and a belt-type fixing device 25.

The optical image writing unit 21 includes a light source, a polygon mirror, an f-θ lens, a reflection mirror, and the like, (which are not shown in FIG. 1), and irradiates a photoreceptor (explained later) with laser light on the basis of image information to be reproduced.

Each of the process cartridges 18 (Y, M, C and K) includes a photoreceptor 1, a charger, a developing device 4, a drum cleaning device for cleaning the photoreceptor 1, and a discharger for decaying charges remaining on the photoreceptor 1.

Since the process cartridges 18 have substantially the same structure, only the process cartridge 18Y for forming yellow color images will be explained. At first, the circumferential surface of the photoreceptor 1Y is charged with a charger (not shown). Next, the optical image writing unit 21 irradiates the charged photoreceptor 1Y with laser light, which has been modulated by yellow image signals and deflected, thereby decaying the charges of the irradiated portions of the photoreceptor 1Y, resulting in formation of an electrostatic latent image for the yellow image on the photoreceptor 1Y. Next, the developing device 4Y develops the electrostatic latent image with a developer including a yellow toner, resulting in formation of a yellow toner image on the photoreceptor 1Y.

The thus prepared yellow toner image is then transferred onto an intermediate transfer belt 110. This transfer process is hereinafter referred to as primary image transfer. After the primary image transfer, the surface of the photoreceptor 1Y is cleaned with the drum cleaning device to remove residual toner particles from the surface.

The thus cleaned photoreceptor 1Y is then discharged with the discharger to remove residual charges therefrom. The circumferential surface of the photoreceptor 1Y is then charged with the charger so that the photoreceptor 1Y has an initial state, i.e., the photoreceptor 1Y is ready for the next image forming operations. The similar image forming operations are performed on the other photoreceptors 1M, 1C and 1K, resulting in formation of magenta, cyan and black toner images on the respective photoreceptors 1M, 1C and 1K.

Next, the intermediate transfer unit 17 will be explained.

The intermediate transfer unit 17 includes the intermediate transfer belt 110, a belt cleaning device 90, a tension roller 14, a driving roller 15 (which is driven by a belt driving motor (not shown)), a secondary transfer backup roller 16, and four primary transfer bias rollers 62Y, 62M, 62C and 62K.

The intermediate transfer belt 110 is supported while tightly stretched by plural rollers including the tension roller 14, and is clockwise rotated endlessly by the driving roller 15. The four primary transfer bias rollers 62 (Y, M, C and K) are arranged so as to contact the inner surface of the intermediate transfer belt 110, and receive a primary transfer bias from a power source (not shown). The four primary transfer bias rollers 62 press the intermediate transfer belt 110 toward the photoreceptors 1, resulting in formation of four primary transfer nips. At the primary transfer nips, primary transfer electric fields are formed between the photoreceptors 1 and the primary transfer rollers 62 due to the primary transfer bias applied to the primary transfer rollers 62.

The yellow toner image formed on the photoreceptor 1Y is primarily transferred onto the intermediate transfer belt 110 due to the primary transfer electric field and the nip pressure. Similarly, the magenta, cyan and black toner images are sequentially transferred onto the intermediate transfer belt 110 to be overlaid on the yellow toner image, resulting in formation of a combined four color toner image on the intermediate transfer belt 110.

The combined four color toner image formed on the intermediate transfer belt 110 is then transferred onto a paper sheet serving as a receiving material (i.e., secondary image transfer) at a secondary transfer nip (explained later). The surface of the intermediate transfer belt 110 is cleaned with the belt cleaning device 90 (which sandwiches the intermediate transfer belt 110 with the driving roller 15) after the secondary image transfer to remove residual toner particles therefrom.

Next, the secondary transfer device 22 will be explained.

The secondary transfer device 22 is located under the intermediate transfer unit 17, and includes two tension rollers 23 and a feeding belt 24, which is stretched by the tension rollers 23. The feeding belt 24 is counterclockwise rotated while driven by at least one of the tension rollers 23. The tension roller 23 on the right side in FIG. 1 and the secondary transfer backup roller 16 sandwich the intermediate transfer belt 110 and the feeding belt 24, resulting in formation of a secondary transfer nip at which the intermediate transfer belt 110 and the feeding belt 24 are contacted with each other. A secondary transfer bias having a polarity opposite to that of the charged toner is applied to the right tension roller 23 from a power source (not shown), resulting in formation of a secondary transfer electric field. Due to this secondary transfer electric field, the combined color toner image on the intermediate transfer belt 110 is electrostatically moved toward the feeding belt 24.

On the other hand, a paper sheet serving as a receiving material is fed from the receiving material feeding section 200 to the pair of registration rollers 49 as explained later in detail. The pair of registration rollers 49 timely feed the paper sheet to the secondary transfer nip. The combined color toner image on the intermediate transfer belt 110 is transferred onto the paper sheet at the secondary transfer nip due to the secondary transfer electric field and the secondary transfer nip pressure. In this regard, a transfer method in which the paper sheet may be charged in a noncontact manner can be used instead of the above-mentioned transfer method in which a secondary transfer bias is applied to the right tension roller 23.

The receiving material feeding section 200 includes plural cassettes 44, which are arranged one by one in the vertical direction while overlying with a space therebetween as illustrated in FIG. 1. In each cassette 44, a feeding roller 42 is contacted with the uppermost paper sheet (serving as a receiving material) in the cassette. By rotating the feeding roller 42, the uppermost paper sheet is fed toward a feeding passage 46.

The feeding passage 46 includes plural pairs of rollers 47 and the pair of registration rollers 49, which are located at the end of the feeding passage 46. The paper sheet is fed to the pair of registration rollers 49 by the plural pairs of rollers 47 through the passage 46. The paper sheet is then pinched by the pair of registration rollers 49. On the other hand, the combined color toner image is fed toward the secondary transfer nip by the rotated intermediate transfer belt 110. The pair of registration rollers 49 timely feed the paper sheet toward the secondary transfer nip so that the combined color toner image is contacted with a proper position of the paper sheet at the secondary transfer nip. Therefore, the combined color toner image is transferred onto the proper position of the paper sheet, resulting in formation of a full color toner image on the paper sheet. The paper sheet bearing the full color toner image thereon is then fed to the fixing device 25 by the feeding belt 24.

The fixing device 25 includes a belt unit in which a fixing belt 26 is rotated endlessly while stretched by two rollers, and a pressure roller 27 pressed to one of the two rollers. The fixing belt 26 and the pressure roller 27 are contacted with each other to form a fixation nip. The paper sheet fed by the feeding belt 24 is pressed at the fixation nip. One of the two rollers, which is pressed by the pressure roller 27, has a heat source therein to heat the fixing belt 26. Therefore, the paper sheet is pressed and heated at the fixation nip, resulting in fixation of the full color toner image on the paper sheet.

The paper sheet bearing the fixed full color image thereon is discharged from the main body of the image forming apparatus to a tray 57 serving as a stacking member by a discharging roller 56. Alternatively, when another image is formed on the backside of the paper sheet, the paper sheet is fed toward the secondary transfer nip by a reversing member.

In order to prepare a copy of an original document, at first the original document is set on a table 30 of the ADF 400. When the original document is a page of a book-form document, the page of the book-form original document is directly set on a glass table 32, which can be exposed by opening the ADF 400. After the book-form original document is set on the glass table 32, the ADF 400 is closed to press the book-form original document toward the glass table 32.

When a copy starting switch is pressed after the original document is set, an original document reading operation of the scanner 300 is started. When the original document is set on the table 30 of the ADF 400, the original document is fed to the glass table 32 and then the original document reading operation is started. In the original document reading operation, a first traveling member 33 and a second traveling member 34 start to travel, and light is emitted from a light source, which is provided on the first traveling member 33, toward the original document. Reflection light reflected from the original document is reflected off a mirror provided in the second traveling member 34, and the reflected light enters into a reading sensor 36 after passing through a focusing lens 35. Thus, the reading sensor 36 obtains image information from the incident light.

In parallel to the original document reading operation, the devices in the process cartridges 18, the intermediate transfer unit 17, the secondary transfer device 22, and the fixing device 25 are driven to operate. The optical image writing unit 21 is also driven to operate, and irradiates the charged photoreceptors 1 with imagewise light (i.e., an optical image having the image information obtained by the reading sensor 36), resulting in formation of electrostatic latent images on the respective photoreceptors 1. As mentioned above, the electrostatic latent images are developed with the respective developers including the respective color toners, resulting in formation of color toner images on the respective photoreceptors 1.

In addition, at almost the same time when the original document reading operation is started, a receiving material feeding operation is started in the receiving material feeding section 200. In the receiving material feeding operation, one of the feeding rollers 42 is rotated to feed a paper sheet contained in one of the cassettes 44 arranged in a receiving material bank 43. In this regard, when plural paper sheets are fed, the paper sheets are separated from each other by a separation roller 45. The paper sheet is fed to the feeding passage 46, and is then fed to the secondary transfer nip by the plural pairs of feeding rollers 47. Alternatively, the receiving material feeding operation may be performed using a manual feed tray 51. In this case, a feeding roller 50 is rotated to feed paper sheets set on the manual feed tray 51 one by one. The paper sheets are separated from each other by a separation roller 52, and the paper sheet is fed to a manual feeding passage 53.

When a multi-color image including two or more color images is prepared, the upper portion of the intermediate transfer belt 110 is stretched by the rollers 14, 15 and 16 so as to be contacted with all the photoreceptors 1Y, 1M, 1C and 1K. However, when a monochrome black image is prepared, the upper portion of the intermediate transfer belt 110 is declined so as to be separated from the photoreceptors 1Y, 1M, and 1C. In addition, among the four photoreceptors 1, only the photoreceptor 1K for forming black images is counterclockwise rotated so that a black toner image is formed on the photoreceptor 1K. In this case, not only the photoreceptors 1Y, 1M and 1C, but also the developing devices 4Y, 4M and 4C are stopped, to prevent wasteful abrasion of the photoreceptors 1Y, 1M and 1C and wasteful consumption of the Y, M and C developers.

The copier 100 includes a controller (not shown in FIG. 6) including a CPU configured to control the operations of the various devices included in the copier, and an operation panel (not shown) including a display and keys. An operator can provide an instruction to the controller by key input. For example, the operator can select a one-side print mode among three kinds of one-side print modes, i.e., direct discharge mode, reverse discharge mode and decurling reverse discharge mode.

Figure 7:
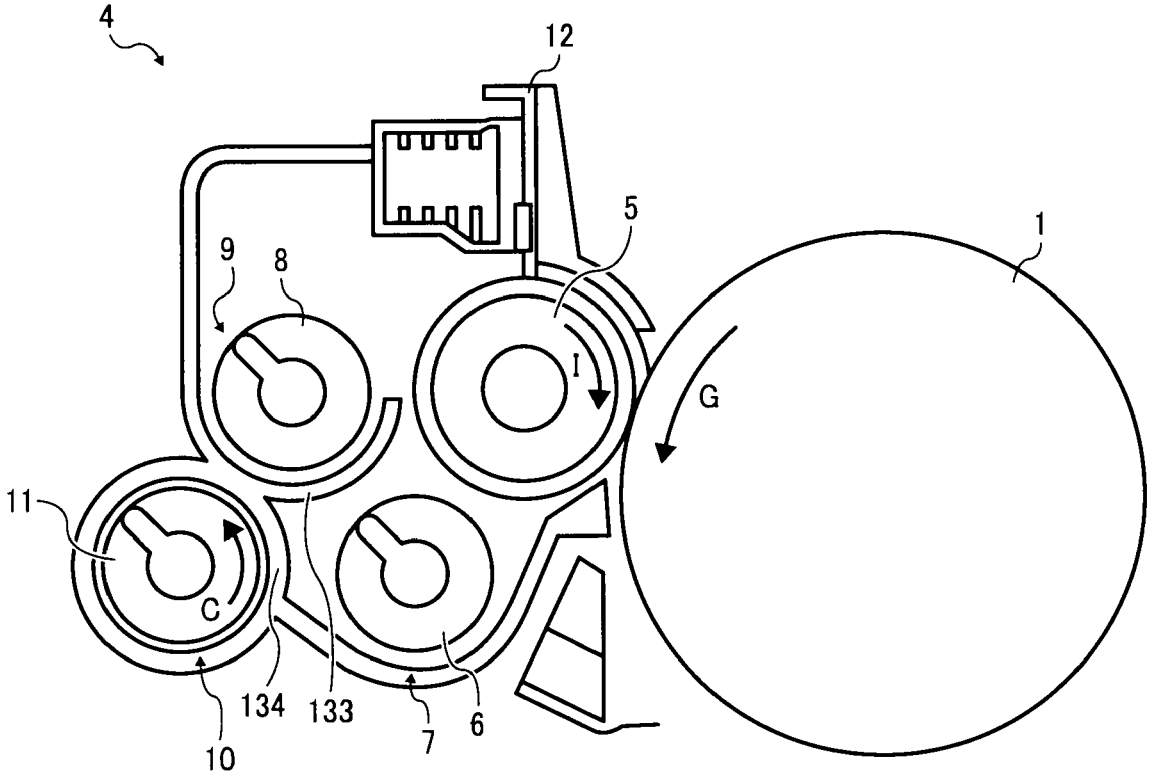
FIG. 7 is a schematic cross-sectional view illustrating an image bearing member (photoreceptor) and a developing device of the copier illustrated in FIG. 6.

FIG. 7 is an enlarged view illustrating a portion of the process cartridge 18, which portion includes the developing device 4 and the photoreceptor 1. Since the process cartridges 18Y, 18M, 18C and 18K are the same except for the color of the toner used for developing, the suffixes Y, M, C and K are omitted in FIG. 7.

As illustrated in FIG. 7, the photoreceptor 1 is rotated in a direction indicated by an arrow G. The surface of the photoreceptor 1 is charged with a charger (not shown). The charged surface of the photoreceptor 1 is exposed to imagewise light emitted from the optical image writing unit 21, resulting in formation of an electrostatic latent image on the photoreceptor 1. The electrostatic latent image is developed with the toner in the developer supplied from the developing device 4, resulting in formation of a toner image on the photoreceptor 1.

The developing device 4 includes a developing roller 5, which serves as a developer bearing member and which is rotated in a direction indicated by an arrow I to supply the developer to the electrostatic latent image on the photoreceptor 1, and the supplying screw 8, which serves as a developer supplying member and which supplies a developer to a developing roller 5 while feeding the developer toward the inner portion thereof (i.e., in a direction of from the front side of the paper sheet, on which FIG. 7 is printed, to the backside of the paper sheet). The supplying screw 8 includes a rotation shaft and a blade provided on the rotation shaft, and serves as a developer feeding screw, which feeds the developer in the axis direction thereof by rotating.

A doctor blade 12 is provided on a downstream side from the opposed position, at which the developing roller 5 and the supplying screw 8 are opposed, relative to the rotation direction I of the developing roller. The doctor blade 12 serves as a developer layer thickness controlling member configured to control the thickness of the developer layer on the developing roller 5.

The developing device 4 further includes the collection screw 6, which is provided on a downstream side from the opposed position, at which the developing roller 5 and the photoreceptor 1 are opposed, relative to the rotation direction I of the developing roller. The collection screw 6 collects the developer used for developing and feeds the collected developer toward the inner portion of the collection screw 6 (i.e., in the same direction as that of the feeding direction of the supplying screw 8). As illustrated in FIG. 7, the developer supplying passage 9 is provided on one side of a supplying screw 8, and a developer collecting passage 7 is provided on an upper side of the collection screw 6.

The developing device 4 further includes a developer agitating passage 10, which is located below a developer supplying passage 9 and is parallel to the developer collecting passage 7. The developer agitating passage 10 includes an agitation screw 11 configured to feed the developer in the direction opposite to the developer feeding direction of the supplying screw 8 while agitating the developer. The developer agitating passage 10 is separated from the developer supplying passage 9 with a portion of a first partition wall 133. An opening is formed on both ends of the first partition wall 133 in the developer feeding direction of the supplying screw 8, and therefore the developer supplying passage 9 and the developer agitating passage 10 are communicated with each other through the openings.

The developer supplying passage 9 is separated from developer collecting passage 7 with another portion of the first partition wall 133, which portion includes no opening.

The developer agitating passage 10 is separated from the developer collecting passage 7 with a second partition wall 134. The second partition wall 134 has one opening on an uppermost stream side in the developer feeding direction of the supplying screw 8, and thereby the developer agitating passage 10 is communicated with the developer collecting passage 7.

Each of the developer supplying screw 8, collection screw 6 and agitation screw 11 is a resin screw, which has, for example, a diameter of 18 mm and a screw pitch of 25 mm and which is rotated at a revolution of about 600 rpm.

The developer layer formed on the developing roller 5 by the doctor blade 12 is fed to the development region at which the developing roller 5 is opposed to the photoreceptor 1 to develop an electrostatic latent image on the photoreceptor 1. The surface of the developing roller 5 has V-shaped grooves or is subjected to a sand-blasting treatment. For example, an aluminum cylinder having a diameter of 25 mm is used as the developing roller 5. The gap between the photoreceptor 1 and the doctor blade 12 is about 0.3 mm.

The developer used for developing electrostatic latent images is collected with the developer collecting passage 7 and the collected developer is fed in the direction opposite to the developer feeding direction of the supplying screw 8. The thus fed developer is then fed to the developer agitating passage 10 through one of the openings of the first partition wall 133, which is located on a portion corresponding to a non-image-forming area of the photoreceptor 1 and which is located on the downstream side relative to the developer feeding direction of the developer collecting passage 7. At a portion of the developer agitating passage 10, which is located on an upstream side relative to the developer feeding direction of the developer agitating passage 10 and which faces one of the openings of the first partition wall 133, a premixed toner (i.e., developer supplement) including a carrier and a toner is supplied to the developer agitating passage 10 from a toner supplying opening provided above the developer agitating passage 10.

Next, flow of the developer in the three developer passages 9, 7 and 10 will be explained.

Figure 8:
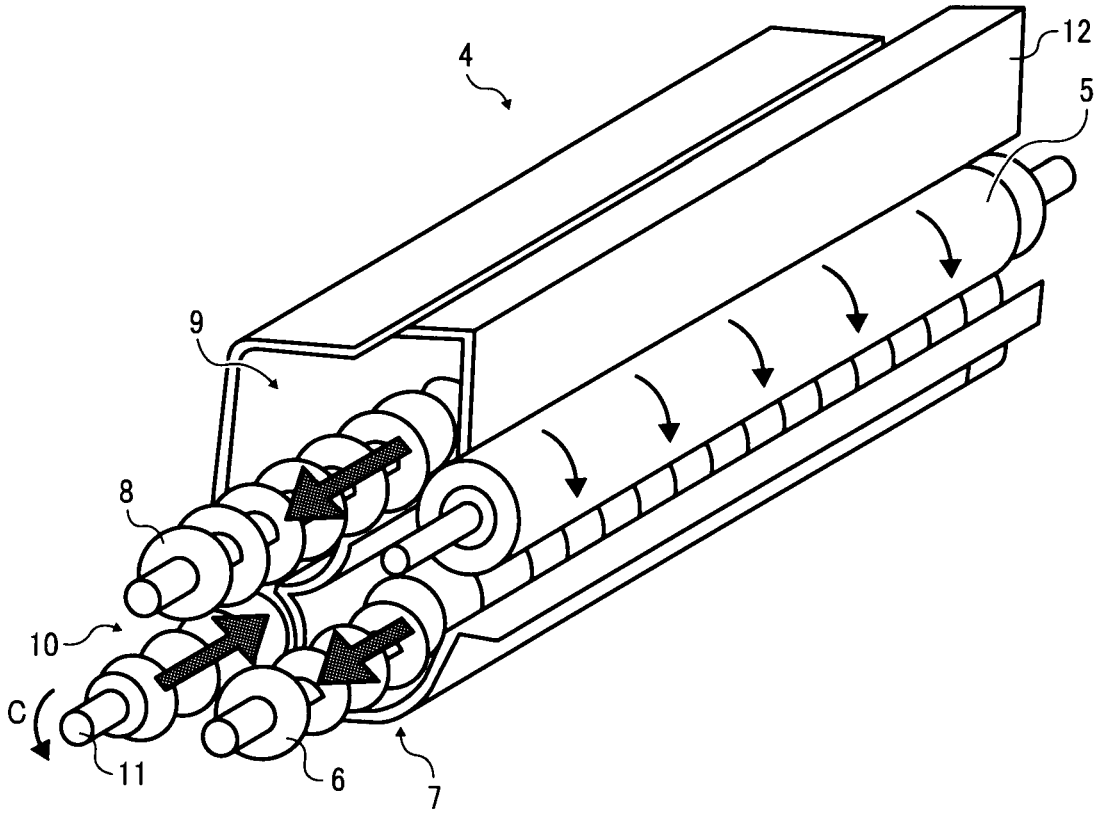
FIG. 8 is a schematic perspective view of the developing device for explaining how the developer flows therein.

FIG. 8 is a perspective cross-sectional view for explaining flow of the developer in the developing device 4. In FIG. 8, arrows indicate the moving directions of the developer. In addition, FIG. 9 is a schematic view illustrating flow of the developer in the developing device 4. In FIG. 9, arrows indicate the moving directions of the developer.

Referring to FIGS. 8 and 9, the developer is supplied from the developer agitating passage 10 to the developer supplying passage 9 as indicated by an arrow D. The developer supplying passage 9 supplies the developer to the developing roller 5 while feeding the developer in the developer feeding direction of the supplying screw 8 as indicated by three outline arrows in FIG. 9. The developer (i.e., excessive developer), which is supplied to the developing roller 5 but is not used for developing until the developer is fed to the downstream side of the developer supplying passage 9, is returned to the developer agitating passage 10 through another opening of the first partition 133 as indicated by an arrow E in FIG. 9.

On the other hand, the developer passing through the development region and fed to the developer collecting passage 7 from the developing roller 5 is fed by the collection screw 6. The developer (collected developer) fed to the downstream side of the developer collecting passage 7 is fed to the developer agitating passage 10 through a collection-use opening of the second partition 134 as indicated by an arrow F in FIG. 9. Although the developer collecting passage 7 is communicated with the developer agitating passage 10 at a downstream side thereof in FIG. 9, the position of the communication path is not limited thereto.

In the developer agitating passage 10, the excessive developer and the collected developer are agitated, and the mixed developer is fed to the downstream side of the developer agitating passage 10 (i.e., the upstream side of the developer supplying passage 9) with the agitation screw 11. The mixed developer is then fed to the developer supplying passage 9 through the opening of the first partition 133 as indicated by the arrow D in FIG. 9.

In addition, a developer supplement (such as toner or premix toner) including a toner and a carrier) is added to the developer agitating passage 10, if necessary. The toner is mixed with the collected developer, and the excess developer, and the mixed developer is fed to the downstream side of the developer agitating passage 10 (i.e., the upstream side of the developer supplying passage 9) by the agitation screw 11 as mentioned above. A toner concentration sensor (not shown) is provided on a lower portion of the developer agitating passage 10. Depending on the output of the toner concentration sensor, a toner supplying device (not shown) of the developing device 4 performs a toner supplying operation in which the developer supplement (such as toner and premix toner) including a toner and a carrier) is supplied from the toner container to the developing device 4. The developer supplement can be added at any portion of the developer agitating passage 10 or the uppermost stream side of the developer supplying passage 9.

The developing device 4 illustrated in FIG. 9 includes the developer supplying passage 9 and the developer collecting passage 7 so that developer supplying and developer collecting are performed in the different passages. Therefore, it is impossible that the developer, which has been used for developing, is mixed with the developer in the developer supplying passage 9. Therefore, occurrence of a problem in that the developer located on the downstream side of the developer supplying passage 9 has a lower toner concentration than the developer in the other portions of the developer supplying passage 9 can be prevented.

In addition, the developing device 4 includes the developer collecting passage 7 and the developer agitating passage 10 so that developer collection and developer agitation are performed in the different passages. Therefore, the developer, which has been used for developing, never falls into the developer in process of agitating. Thus, the well agitated developer is supplied to the developer supplying passage 9. Therefore, the developer in the developer supplying passage 9 has constant toner concentration in the developer feeding direction, thereby forming toner images having a constant image density on the photoreceptors 1.

Figure 16:
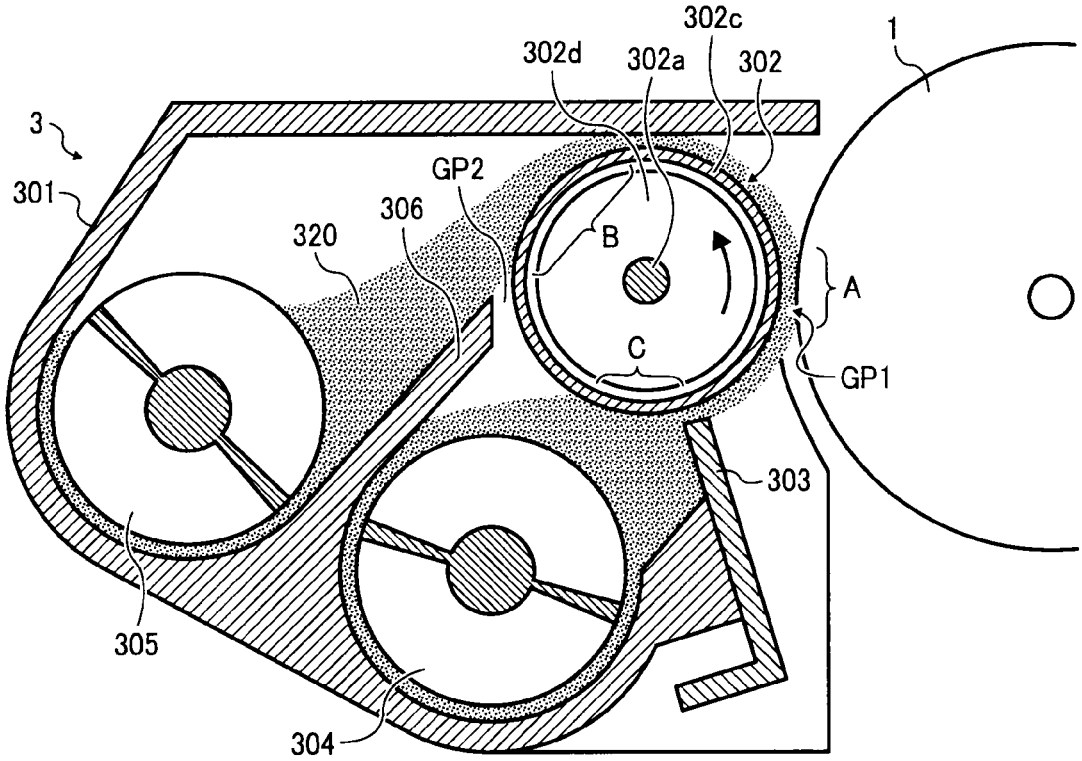
FIG. 16 is a schematic cross-sectional view illustrating an image bearing member and another example of a developing device of the copier.

FIG. 16 illustrates another developing device (two-passage one-way circulation developing device) for use in the image forming apparatus of the present invention.

Referring to FIG. 16, a developing device 3 includes a casing 301, and a developer supplying member 304 for agitating and feeding a developer 320 in the developer supplying passage, a developer agitating member 305 for agitating and feeding the developer 320 in the developer agitating passage, and a developing roller 302, which are arranged in the casing 301. The developing roller 302 has almost the same length (in the axis direction) as the photoreceptor 1.

The developing roller 302 is arranged so as to face the photoreceptor 1 to form a development region A. The casing 301 has an opening so that the developing roller 302 is exposed and forms the development region A with the photoreceptor 1.

The developer 320 in the casing 301 is fed to the development region A by the developing roller 302. The toner included in the developer 320 is adhered to an electrostatic latent image formed on the photoreceptor 1 at the development region A, resulting in formation of a visual image (i.e., a toner image) on the photoreceptor 1.

As mentioned above, the developing roller 302, developer supplying member 304, and developer agitating member 305 are arranged in the casing 301 of the developing device 3 to circulate the developer 320 while agitating the developer. In addition, a developer layer thickness controlling member 303 is arranged in the casing 301 to control the thickness of the developer layer formed on the developing roller 302.

The developing roller 305 includes a fixed shaft 302*a*, a sleeve 302*c* having a cylindrical form, which is made of a nonmagnetic metal such as aluminum, and a magnet roller 302*d*, which has plural magnets fixed to a fixed member (such as casing 301) so that the magnets are directed in predetermined directions. The sleeve 302*c* rotates around the magnet roller 302*d* to feed the developer 320, which is attracted by the magnet roller 302*d*.

The developing roller 302 and the photoreceptor 1 is not directly contacted with each other at the development region A, and a predetermined gap GP1 is formed between the surfaces thereof. Since the developer on the developing roller 302 is erected due to a magnetic field formed by the magnets in the developing roller 302 to form a magnetic brush of the developer 320, the magnetic brush (which includes the toner and the carrier) is contacted with the surface of the photoreceptor 1, resulting in formation of a toner image on the photoreceptor 1.

In this developing device 3, a power source (which is not shown and which is grounded) applies a bias to the shaft 302*a* of the developing roller 302 to apply a voltage to the sleeve 302*c*. On the other hand, the electroconductive substrate serving as an undermost layer (not shown) of the photoreceptor 1 is grounded.

Thus, an electric field is formed in the development region A, and thereby the toner in the developer 320 is moved toward the photoreceptor 1 due to the potential difference between the sleeve 302*c* and the photoreceptor 1.

Electrostatic latent images are formed on the photoreceptor 1 by charging (for example, negatively) the photoreceptor 1 with a charger (not shown) and then irradiating the charged photoreceptor 1 with the optical image writing unit 21 so that the irradiated portions correspond to the image portions, to reduce the total light irradiating time. The thus formed electrostatic latent images are developed with a negatively charged toner using a reverse development method. The development method is not limited thereto, and any other development methods (including change of the charging methods) can be used.

After developing electrostatic latent images, the developer on the developing roller 302 is fed to the downstream side due to rotation of the developing roller 302, followed by entering into the casing 301. The casing 301 has a curved portion, which is located close to the sleeve 302*c* to prevent the toner from being scattered. The developer 320 is then separated from the developing roller 302 in a developer separating region B illustrated in FIG. 16 by the magnetic force of the magnet roller 302*d* in the developing roller 302. In this regard, the developer 320 thus separated from the developing roller 302 has a relatively low toner concentration. Therefore, if the developer 320 is not separated from the developing roller 302 and is used again for developing electrostatic latent images in the development region A, images with a predetermined image density cannot be produced.

In order to prevent such a problem, the developer 320 used for developing is separated from the developing roller 302 in the developer separating region B. The developer 320 thus separated from the developing roller 302 is mixed with a fresh toner (developer supplement) and the mixture is agitated in the casing 301 so that the developer 320 has the predetermined toner concentration and the toner is charged so as to have the predetermined charge quantity (hereinafter this developer is sometimes referred to as the revived developer). The developer 320 is then fed by the developer agitating member 305 to the downmost stream side of the developer agitating passage.

The developer thus fed to the developer supplying passage is then drawn by the developing roller 302 in a developer drawing region C illustrated in FIG. 16. When the thus drawn developer passes through the developer layer thickness controlling member 303, a developer layer having a predetermined thickness is formed on the developing roller 302 while forming a magnet brush. The developer layer is fed to the development region A.

Next, the configuration of the developing device 3 will be explained by reference to FIGS. 16, 17 and 18.

As illustrated in FIG. 16, the developer supplying member 304 is provided in the vicinity of the developing roller 302 and the developer drawing region C. The developer supplying member 304 is located on an upstream side from the developer layer thickness controlling member 303. As illustrated in FIGS. 17 and 18, the developer supplying member 304 has a screw form such that a spiral is formed around a rotation shaft, and is rotated around an axis O-304*a* which is parallel to an axis O-302*a* (same as a centerline O-302 of the developing roller 302). The developer supplying member 304 feeds the developer along the shaft thereof in a direction indicated by an arrow D11 in FIG. 17 (i.e., in a direction of from the inside to the front side thereof).

As illustrated in FIG. 16, the developer agitating member 305 is provided in the vicinity of the developing roller 302 and the developer separating region B. As illustrated in FIG. 17, the developer agitating member 305 has a screw form such that a spiral is formed around a rotation shaft, and is rotated around an axis O-305*a* which is parallel to the axis O-302*a* (same as the center line O-302 of the developing roller 302). The developer agitating member 305 feeds the developer along the shaft thereof in a direction indicated by an arrow D12 in FIG. 17 (i.e., in a direction of from the front side to the inside thereof). Namely, the developer agitating member 305 feeds the developer in the direction D12 opposite to the developer supplying direction D11.

It is preferable that the developer agitating member 305 is located obliquely above the developer supplying member 304 and the space surrounding the developer supplying member 304 is adjacent to the space surrounding the developer agitating member 305. The inner edges of the developer supplying member 304 and the developer agitating member 305 are located on a relatively inner side from the inner edge of the developing roller 302 so that the developer can be supplied to the edge portion of the developing roller 302 similarly to the center portion thereof. Similarly, the front edges of the developer supplying member 304 and the developer agitating member 305 are located on a relatively front side from the front edge of the developing roller 302 so that the developer supplement (toner or premix toner) can be supplied from the front edges. The developer layer thickness controlling member 303 has almost the same length of the developing roller 302.

A partition 306 is provided to separate the space surrounding the developer supplying member 304 from the space surrounding the developer agitating member 305 except for both the edge portions of the developing roller 302 in the axis direction of the developing roller 302. The partition 306 is provided on a portion of the casing 301 while the tip of the partition 306 is not supported as illustrated in FIG. 16.

As mentioned above, the partition 306 is located so as to face the developing roller 302 except for the edge portions thereof, and in contrast the edge portions of the developer supplying member 304 and the developer agitating member 305 extends from both the edge portions of the developing roller 302. Therefore, the developer fed in the direction D12 by the developer agitating member 305 reaches the side wall of the casing 301 and is moved toward the developer supplying passage (i.e., in a direction D13 illustrated in FIG. 17). The developer is then fed in the direction D11 through the developer supplying passage by the developer supplying member 304. Similarly, the developer fed in the direction D11 by the developer supplying member 304 reaches the side wall of the casing 301 and is moved toward the developer agitating passage (i.e., in a direction D14 illustrated in FIG. 17). The developer is then fed in the direction D12 through the developer agitating passage by the developer agitating member 305.

The reason why the partition 306 is not provided for both edge portions of the developing roller 302 is that the developer can be flown in the directions D13 and D14, i.e., the developer is circulated in the order of the directions D11, D14, D12 and D13.

Figure 18:
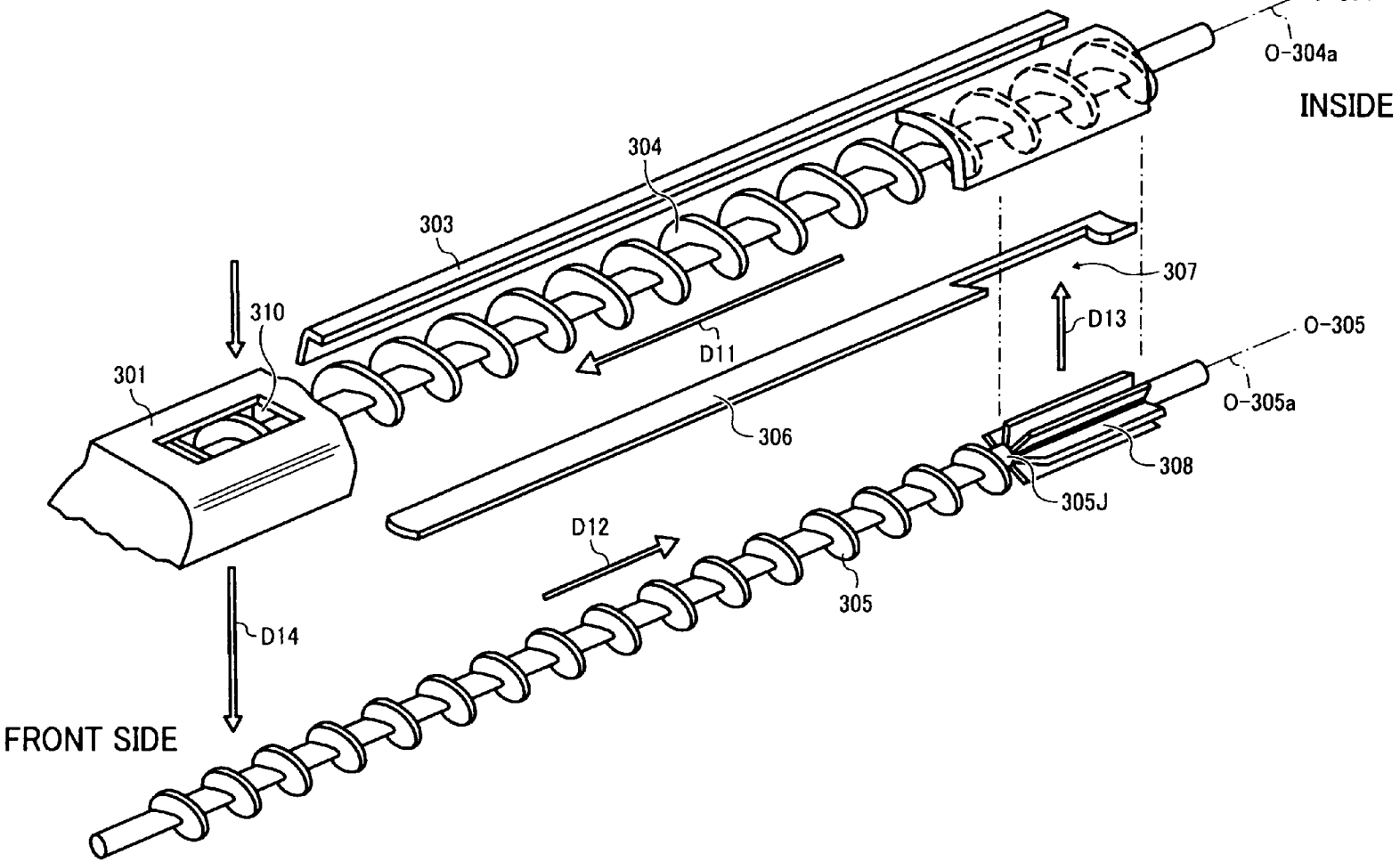

As illustrated in FIG. 18, the partition 306 can have an opening 307 at an inner portion thereof so that the developer can be fed from the developer agitating passage to the developer supplying passage through the opening 307. In this case, the edge of the partition 306 may extend to the inner edge portion of the developing roller 302.

It is clear from comparison of FIG. 16 with FIG. 7 that the length of the developing device 3 (illustrated in FIG. 16) in the direction perpendicular to the direction D11 (or D12) is smaller than that of the developing device 4 (illustrated in FIG. 7) because only the two feeding members (i.e., the developer feeding member 304 and the developer agitating member 305) are arranged in the vicinity of the developing roller 302. Therefore, the developing device 3 has a smaller size than the developing device 4.

Although the developing device 3 has a compact size, only a developer which includes a toner at a predetermined concentration and in which the toner and a carrier are mixed well is supplied to the developing roller 302 because the partition 306 is provided. Namely, the developer used for developing is not directly returned to the developing roller 302 and is fed and agitated by the developer agitating member 305. Therefore, the developer supplied to the developing roller 302 has a predetermined toner concentration and a predetermined charge quantity, thereby stably forming high quality images.

The partition 306 not only forms the developer supplying passage by supporting the developer 320 agitated and fed by the developer supplying member 304, but also prevents the developer, which is used for developing and which is separated from the developing roller 302 and is fed by the developer agitating member 305 in the developer agitating passage, from being moved to the developer supplying passage due to attraction (magnetic force) of the developing roller 302.

In order to securely exercise the function of the partition 306, a gap GP2 between the tip of the partition 306 and the circumferential surface of the developing roller 302 is preferably from 0.2 to 1 mm. When the gap GP2 is too narrow, a problem in that the tip of the partition 306 hits the surface of the developing roller 302 due to eccentricity of the developing roller 302 can occur. In contrast, when the gap GP2 is too wide, a problem in that the developer in the developer agitating passage is moved to the developer supplying passage due to attraction of the developing roller 302 can occur. By thus setting the partition 306, the function of the partition 306 can be fully exercised even when the position of the partition 306 relative to the developer separating region B is changed. Namely, the flexibility of location of the partition 306 is relatively large.

Even when the partition 306 is farther apart from the developer separating region B, the function of the partition 306 can be exercised. However, in this case the partition 306 regulates a large amount of developer, and thereby a large stress is applied to the developer. Therefore, it is not preferable.

In this case, as illustrated in FIG. 16, it is preferable that the developer separating region B is located on an opposite side of the developing roller 302 from the development region A, the developer drawing region C is located on a downstream side from the developer separating region B, and the partition 306 is provided at a location between the developer separating region B and the developer drawing region C, in which the amount of the developer borne on the developing roller 302 is relatively small, in such a manner that the tip of the partition 306 faces the developing roller 302. By setting the partition 306 in such a manner, the function of the partition 306 can be fulfilled, even when the gap GP2 falls outside the above-mentioned range of from 0.2 to 1.0 mm because the amount of the developer borne on the developing roller 302 is relatively small at the partition 306. Needless to say, it is more preferable that the gap GP2 is set to fall in the range of from 0.2 to 1.0 mm, because the stress applied to the partition 306 can be further reduced.

Figure 17:
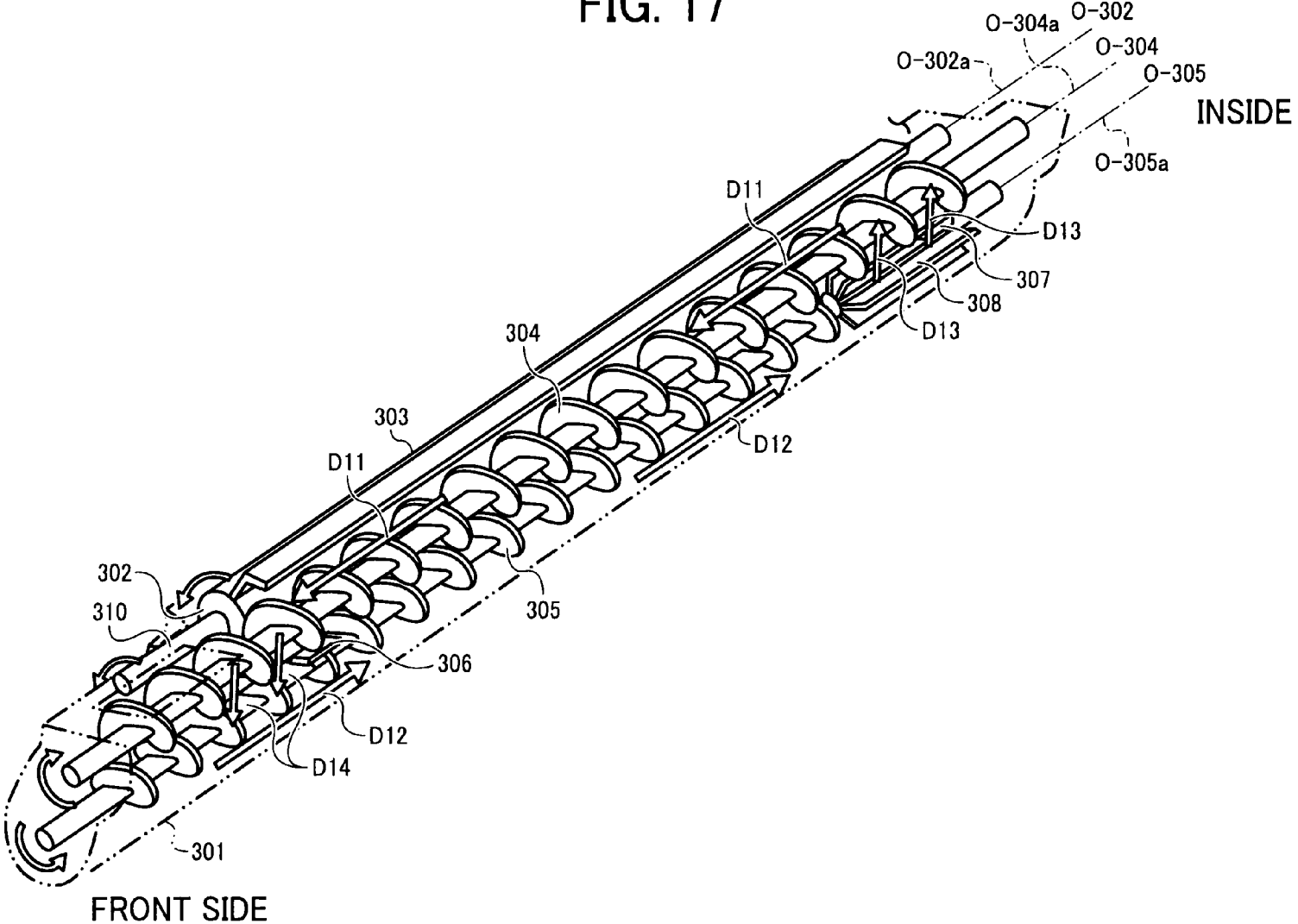
FIGS. 17 and 18 are schematic perspective and exploded views illustrating the developing device illustrated in FIG. 16.

As illustrated in FIGS. 17 and 18, the developer agitating member 305 agitates and feeds the developer, which has been separated from the developing roller 302, toward the inside of the developing device 3 (i.e., in the direction D12). Since the opening 307 is present at the inner side of the partition 306, the developer 320 fed by the developer agitating member 305 is fed to the developer supplying passage (i.e., in the direction D13).

FIG. 19 illustrates flow of the developer in the developing device 3. The developer is fed to the developer supplying passage having a reference number 304P from the developer agitating passage having a reference number 305P as indicated by the arrow D. The developer in the developer supplying passage 304P is fed as indicated by three outline arrows while a part of the developer is fed to the developing roller 302 to be used for developing as indicated by black head arrows. The developer used for developing (i.e., the developer passing through the development region) is directly fed to the developer agitating passage 305P. The developer fed to the downstream side of the developer supplying passage 304P without use for developing is fed to the upstream side of the developer agitating passage 305P as indicated by the arrow E to be mixed with the developer used for developing in the developer agitating passage 305P. The mixed developer is fed to the downstream side of the developer agitating passage 305P as indicated by three outline arrows.

As illustrated in FIG. 18, the portion of the developer agitating member 305 facing the opening 307 may be a bladed wheel 308. The bladed wheel 308 has plural blades, which are provided on a shaft 305J of the developer agitating member 305 and which radially extend from the center line O-305 of the developer agitating member 305. The blade wheel 308 has a function of scattering the developer 320.

As illustrated in FIGS. 17 and 18, the center line O-304 of the developer supplying member 304 and the center O-305 of the developer agitating member 305 are substantially located on a vertical line, and the bladed wheel 308 scatters the developer along the inner wall of the casing 301. Therefore, the opening 307 preferably extends from a point, which is slightly closer to the inner wall of the casing 301 than the vertical line connecting the center lines O-304 and O-305, to the inner wall of the casing 301 so that the scattered developer can be well fed to the developer supplying passage from the developer agitating passage.

The rotation direction of the developer supplying member 304 is preferably opposite to that of the developing roller 302. This is because such a screw feeds a material in the axis direction thereof while collecting the material in the rotating direction. Namely, by rotating the developer supplying member 304 in the direction opposite to that of the developing roller 302, the developer supplying member 304 feeds the developer while collecting the developer to the developing roller 302, and thereby the developer can be efficiently supplied to the developing roller 302.

The rotation direction of the developer agitating member 305 is preferably the same as that of the developing roller 302. In this case, the developer agitating member 305 feeds the developer while collecting the developer in such a direction that the developer is separated from the developing roller 302. Therefore, occurrence of a problem in that the developer separated from the developing roller 302 by the magnetic force of the magnets in the developing roller 302 or by the partition 306 is adhered again to the developing roller 302 can be prevented. Therefore, the developer used for developing and having a low toner concentration is prevented from being fed to the developer supplying member 304.

Since the toner in the developer 320 in the developing device 3 is consumed as the developing operations are repeated, it is necessary to supply the toner to the developer 320 from the outside of the developing device 3. As illustrated in FIG. 18, it is preferable to supply a developer supplement (i.e., a fresh toner or a premix toner including a carrier and a toner) from an opening 310 located near the front end portion of the developer agitating member 305 and the developer separating region B. In this case, the added toner can be well mixed with the developer by the developer agitating member 305 without direct use for developing, resulting in revival of the developer. Thus, the revived developer, which includes the toner at the predetermined concentration and in which the toner is well charged, is supplied to the developing roller 302. The point at which the developer supplement is added is not limited to the point mentioned above. The developer supplement can be added at any portion of the developer agitating passage or the uppermost stream side of the developer supplying passage.

The developer agitating passage only collects the developer separated from the developing roller 302, namely the developer agitating passage does not supply the developer to the developing roller 302. Therefore, a problem in that the developer in which the supplied fresh toner is unevenly dispersed is supplied to the developing roller can be avoided.

The mixture of the fresh toner and the developer used for developing and having a low toner concentration is agitated and fed to the inner side of the developing device 3 by the developer agitating member 305. Thus, after the toner concentration of the developer is normalized, the developer is fed to the developer supplying passage to be used for developing.

In the developing device 3, the developer in the developer supplying passage is fed to the front side from the inside thereof, and the developer is drawn by the developing roller 302. The developer thus drawn by the developing roller passes through the gap between the developing roller 302 and the developer layer thickness controlling member 303. The developer layer on the developing roller 302 forms magnet brushes, and the magnet brushes are contacted with the photoreceptor 1 to be used for developing electrostatic latent images formed on the photoreceptor 1. The developer used for developing is fed to the inner side of the developing device 3 by the developer agitating member 305.

Thus, the developer is circulated in the developing device 3 as indicated by the arrows D11, D14, D12 and D13. Since the developer in the developer supplying passage is used for developing before being fed to the front side of the developing device 3, the amount of the developer fed to the inside of the developing device 3 by the developer agitating member 305 is large. Therefore, the developer tends to stay at the inside of the developing device 3. The thus staying developer prevents smooth circulation of the developer in the developing device 3. Occurrence of such a circulation problem can be prevented by enhancing the developer feeding ability (per unit time) of the developer supplying member 304 so as to be greater than that of the developer agitating member 305. By using this method, the amount of the developer fed by the developer agitating member 305 can be balanced with the amount of the developer fed by the developer supplying member 304 at the inner side of the developing device 3, and thereby the developer is stably circulated smoothly in the developing device 3 for a long period of time. Specifically, for example, by increasing the diameter of the screw of the developer supplying member 304 so as to be greater than that of the screw of the developer agitating member 305, the developer feeding ability of the developer supplying member 304 can be enhanced so as to be greater than that of the developer agitating member 305. The same effect can be produced by increasing the spiral pitch of the screw of the developer supplying member 304, by increasing the revolution of the screw or by enlarging the space of the developer supplying passage.

Figure 10:
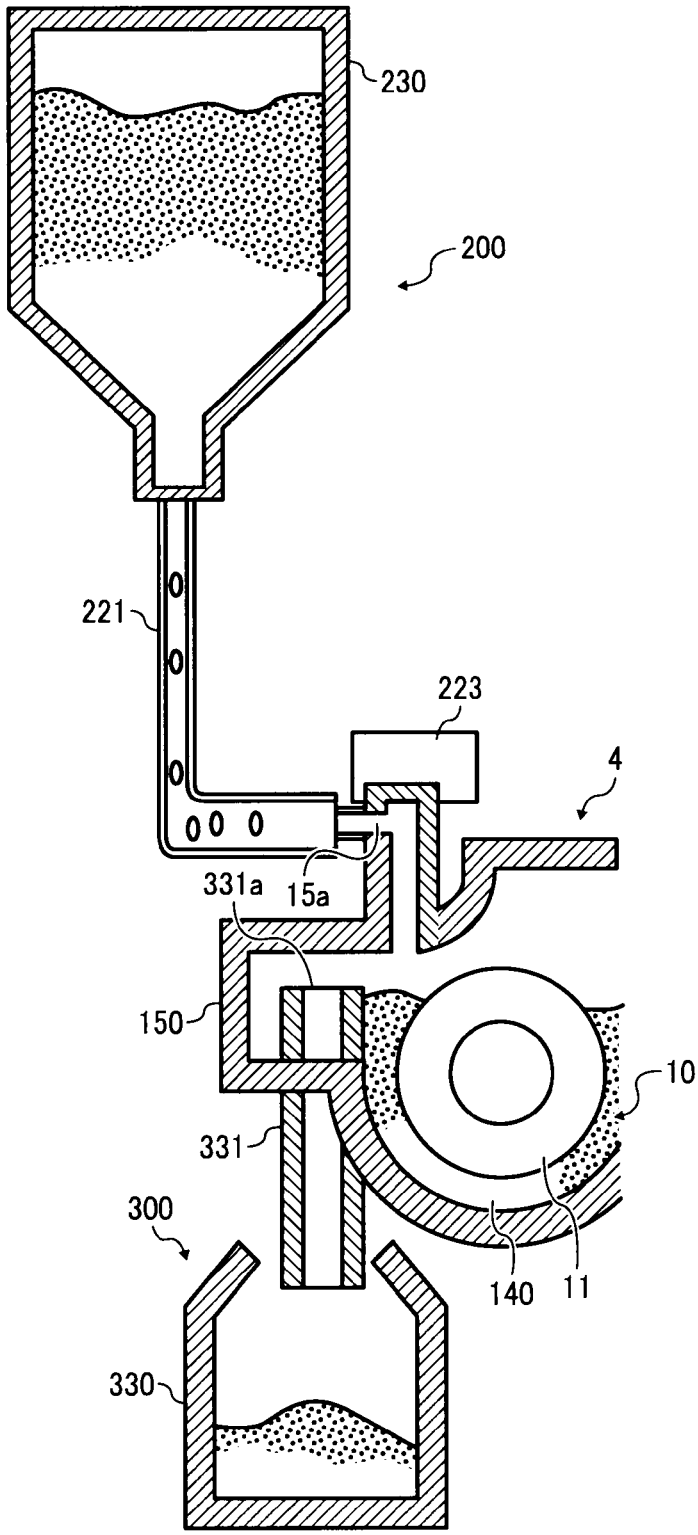
FIG. 10 is a schematic cross-sectional view illustrating a developer supplying device.

In this example of the image forming apparatus of the present invention, a premix toner, which serves as a developer supplement and which includes a fresh toner and the above-mentioned carrier including the core material 26 and the cover layer 27 including the first particulate material G1 and the second particulate material G2, is contained in a container 230 as illustrated in FIG. 10. The premix toner is supplied from the container 230 to a developer containing portion 140 of the developing device.

The premix toner supplied to the developer containing portion 140 is mixed with the developer in the developing device 4 by the agitation screw 11. In this case, the carrier particles are strongly contacted with the toner particles and other carrier particles. Therefore, the problem in that the cover layer 27 is peeled from the core material 26 tends to be easily caused. However, as mentioned above, the carrier used for the developer of the present invention has good resistance to impact, and thereby occurrence of such a peeling problem can be prevented. In addition, as mentioned above, the spent toner adhered to the surface of the carrier is scraped off by the projected first particulate material G1, and thereby occurrence of the spent toner problem can be prevented. In addition, the cover layer 27 has high mechanical strength due to the second particulate material G2 included in the cover layer 27, and thereby occurrence of the peeling problem can be prevented. Therefore, the developer in the developer containing portion 140 can stably maintain good charging property for a long period of time.

The developer contained in the developing device preferably includes the carrier in an amount of from 85% to 98% by weight based on the total weight of the developer. When the carrier content is too low (i.e., the toner content is too high), the toner tends to be scattered, resulting in formation of abnormal images. In contrast, when the carrier content is too high, the charge quantity of the toner excessively increases and the toner cannot be well supplied, resulting in formation of low density images.

Next, the peripheral members of the developing device will be explained.

FIG. 10 illustrates a developer supplying device provided in the image forming apparatus of the present invention.

Referring to FIG. 10, a developer supplying device 200 including a developer supplement (a premix toner in this case) including a fresh toner and the carrier mentioned above is provided above the developing device 4, and a developer discharging device 300 for discharging the excess developer from the developing device 4 is provided below the developing device 4. In FIG. 10, the developer supplying passage, developer collecting passage and developer agitating passage, which are separated with each other by a partition, are not illustrated, and the positional relationship among the three passages is not illustrated. However, the developing device 4 is illustrated in FIGS. 7-9.

In the developing device 4 illustrated in FIG. 10, almost all the deteriorated developer is discharged by the developer discharging device 300. However, a part of the deteriorated developer can remain in the developer containing portion 140. In addition, when the consumption of the toner in the image forming apparatus is little, the amount of the replaced carrier is small, and therefore the period in which the developer stays in the developer containing portion 140 is long.

In this example, both the carrier included in the premix toner contained in the container 230 and the carrier included in the developer in the developer containing portion 140 are the above-mentioned carrier. Therefore, even when the developer is used for a long period of time without being replaced or stays in the developer containing portion 140 for a long period of time, deterioration of the carrier can be prevented. Namely, even when the developer is used for a long period of time, the developer stably maintains good charging property.

Referring to FIG. 10, the developer supplying device 200 includes the container 230 configured to contain the premix toner (i.e., developer supplement) to be supplied to the developing device 4, and a developer supplier 220 (illustrated in FIG. 11), which is connected with the container 230 and the developing device 4 to feed the premix toner to the developing device 4. The developer supplying device 200 will be explained in detail by reference to FIG. 10.

The developer discharging device 300 includes a collection container 330 configured to contain an excess of the developer flowing out of the developer containing portion 140, and a discharging pipe 331 serving as a discharging device configured to feed the excess developer to the collection container 330. The discharging pipe 331 has an upper opening 331*a*, which is provided on a predetermined level so that the developer exceeding the opening 331*a* is discharged to the collection container 330 through the discharging pipe 331.

The developer discharging device 300 is not limited to the above-mentioned example. For example, the developer discharging device 300 can have a configuration such that an exit is formed on a predetermined position of a housing 150, and the developer discharged from the exit is fed to the collection container 330 by a feeding device such as discharging screws. Needless to say, it is possible to provide such a feeding device on or in the discharging pipe 331 in the above-mentioned example.

The developer supplement contained in the container 230 includes at least a toner and a carrier. The toner contained in the container 230 is preferably the toner mentioned below, and the carrier is preferably the above-mentioned magnetic carrier including the core material 26 and the cover layer 27 formed on the core material 26.

The toner contained in the container 230 is preferably the same as the toner included in the developer in the developing device. In addition, the carrier contained in the container 230 is preferably the same as the carrier included in the developer in the developing device.

Figure 11:
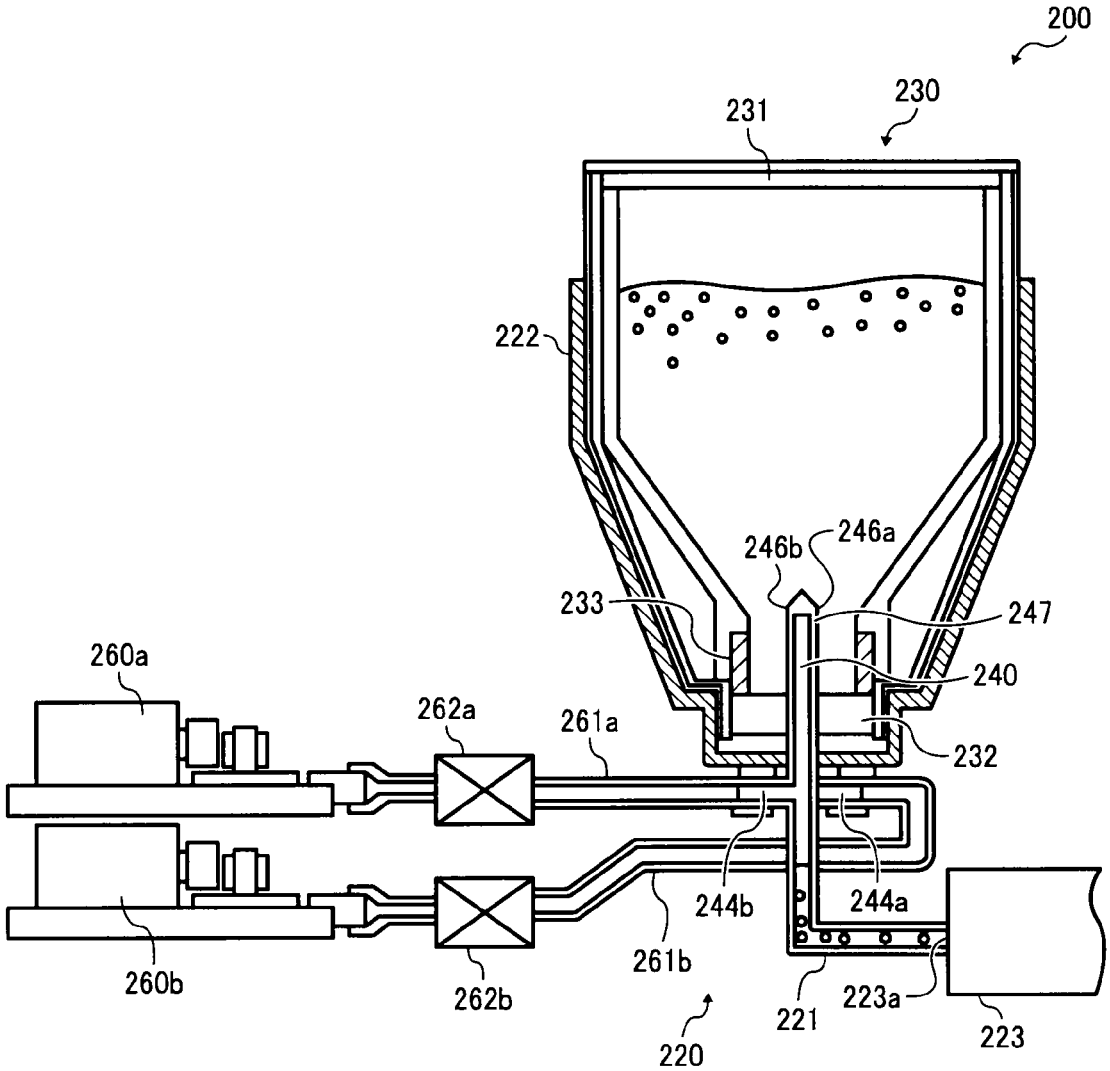
FIG. 11 is a schematic cross-sectional view illustrating a developer supplier of the developer supplying device.
Figure 14:
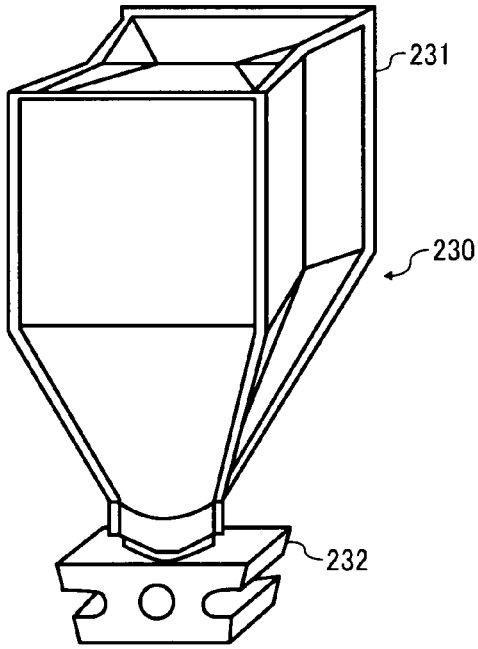
FIG. 14 is a schematic perspective view of a container filled with a developer supplement.
Figure 15:
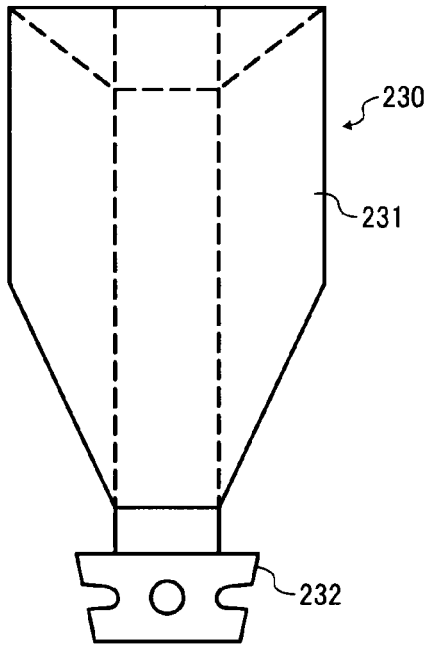
FIG. 15 is a schematic front view of the container, which is shrunk because the developer supplement is discharged therefrom.

As illustrated in FIGS. 11 and 14-15, the container 230 can include a deformable container, which can change its form as the developer supplement is discharged therefrom.

As illustrated in FIGS. 10 and 11, the developer supplement in the container 230 is fed to the developing device 4 by a screw pump 223.

The developer supplying device 200 will be explained in detail by reference to FIGS. 11-15.

FIG. 11 is a schematic view illustrating the developer supplying device 200 for use in the image forming apparatus of the present invention. The container 230 of the developer supplying device 200 includes a volume-reducible bag-form container 231. As the developer supplement in the container 230 is supplied to the developing device 4, the bag-form container 231 reduces its volume due to reduction of the pressure in the bag-form container 231.

As illustrated in FIGS. 10 and 11, the developer supplier 220 includes the screw pump 223, which is provided on the housing 150 so as to be connected with a developer entrance 15*a* to feed the developer supplement in the container 230, and a nozzle 240 connected with the screw pump 223, and an air supplying device (260*a* and 260*b* in FIG. 11) connected with the nozzle 240. The developer supplier 220 supplies a proper amount of the developer supplement from the container 230 to the developer containing portion 140 according to the information concerning the concentration of the toner in the developer in the developer containing portion 140, which is obtained by a toner concentration sensor (not shown) provided on the developer containing portion 140.

A tube 221 is provided to connect the screw pump 223 with the nozzle 240. The tube 221 is preferably a tube made of a flexible material having good toner resistance (such as polyurethane rubbers, nitrile rubbers and EPDM rubbers.

In addition, the developer supplying device 200 includes a container holder 222, which is configured to support the bag-form container 231 and which is made of a rigid material such as resins.

The container 230 includes the bag-form container 231 and a cap 232 configured to form a discharging opening through which the developer supplement is discharged.

Suitable materials for use in the bag-form container 231 include materials having good dimensional accuracy. Specific examples thereof include polyester resins, polyethylene resins, polypropylene resins, polystyrene resins, polyvinyl chloride resins, acrylic resins, polycarbonate resins, ABS resins, polyacetal resins, and the like.

A sealing member 233, which is made of a material such as sponges and rubbers, is provided on the cap 232. The sealing member 233 has a cross cut, into which the nozzle 240 is inserted so that the container 230 is fixedly connected with the developer supplier 220.

In this example, the cap 232 is provided below the container 230. Namely, the cap 232 is located below the container 230 and present on a plumb line of the container 230. However, the position of the cap 232 is not limited thereto, and the cap 232 can be provided at a position horizontally or obliquely separated from the container 230.

The container 230 is replaced with a new container when the developer supplement therein is exhausted. Since the container 230 has the above-mentioned configuration, replacement (attachment and detachment) of the container 230 can be easily performed, and in addition leaking of the developer supplement in the container replacement operation and the developer supplying operation can be prevented.

The size, shape, structure and constitutional material of the bag-form container 231 are not particularly limited, and are determined depending on the application of the container.

With respect to the shape, the bag-form container 231 is preferably a cylinder having a spiral groove on the inner surface thereof so that the developer supplement therein can be smoothly moved toward the exit of the container when the container is rotated. In addition, it is more preferable that all or part of the bag-form container 231 having a spiral groove is folded like an accordion.

The container 230 is easily attached to or detached from the developer supplying device 200 while having good combination of preservability, transportability and handling property.

Figure 12A:
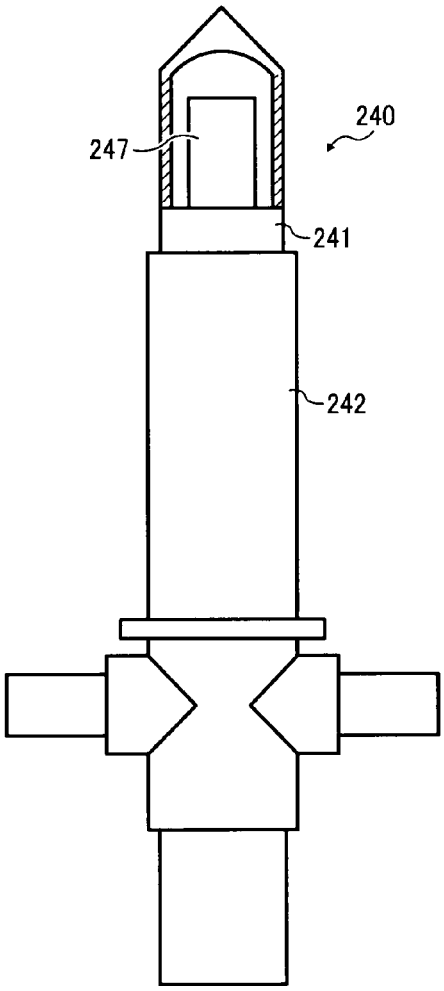
FIGS. 12A-12C are schematic views illustrating the nozzle of the developer supplier.
Figure 12B:
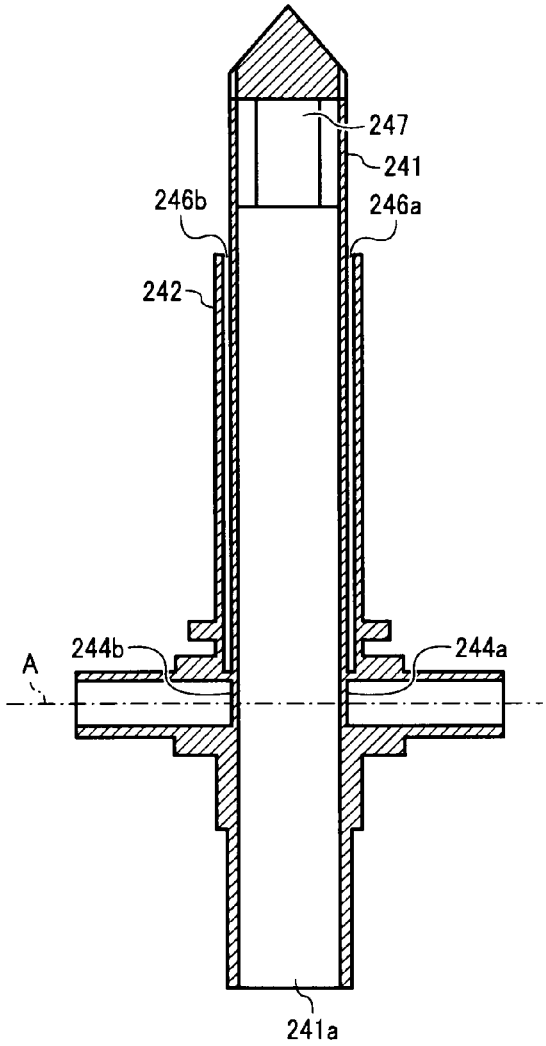
Figure 12C:
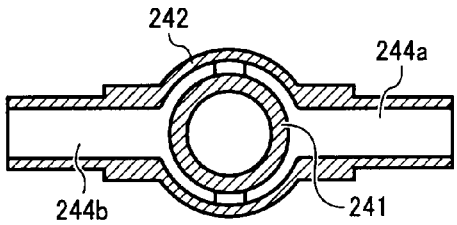

FIGS. 12A, 12B and 12C are a schematic view, and cross-sectional views of the nozzle 240 of the developer supplier 220, respectively. FIG. 12C is a cross sectional view of the nozzle 240 when the nozzle 240 is cut at a surface A illustrated in FIG. 12B. As illustrated in FIG. 12B, the nozzle 240 includes an inner tube 241, and an outer tube 242 containing the inner tube 241 therein. The inside of the inner tube 241 serves as a developer feeding passage 241*a*, through which the developer in the container 230 is discharged. Specifically, the developer supplement in the container 230 is sucked by the screw pump 223 through the developer feeding passage 241*a* due to the suction power of the screw pump 223.

Figure 13:
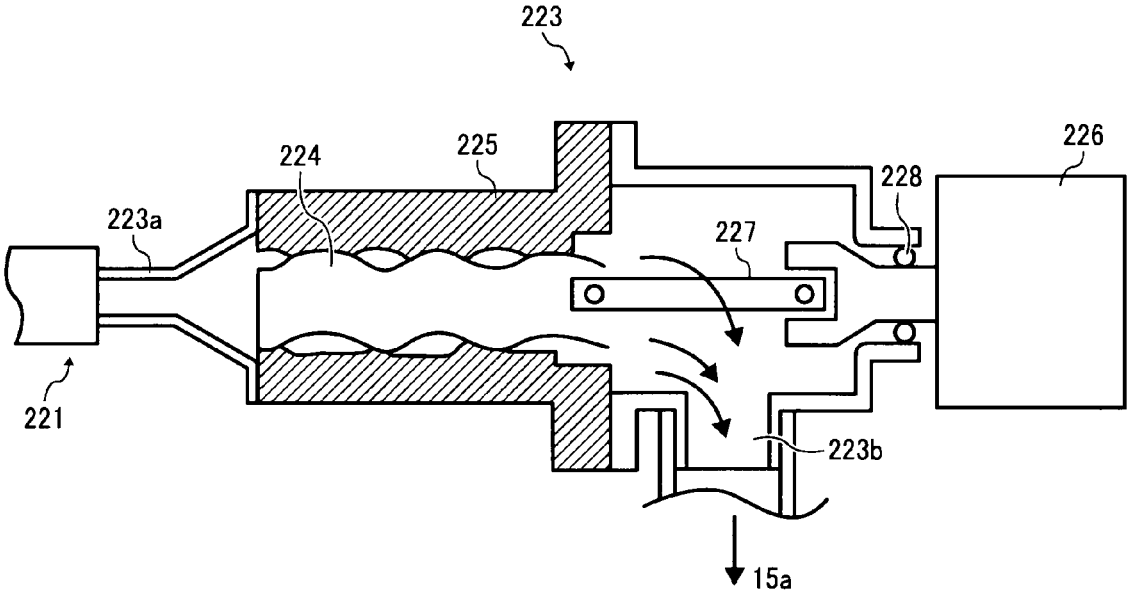
FIG. 13 is a schematic cross-sectional view illustrating a screw pump of the developer supplying device.

FIG. 13 illustrates the cross-section of the screw pump 223. The screw pump 223 illustrated in FIG. 13 is a uniaxial eccentric screw pump 223 having a rotor 224 and a stator 225. As illustrated in FIG. 13, the rotor 224 has a spirally twisted form and a circular cross section, and is made of a hard material. The rotor 224 is engaged with the stator 225. The stator 225 is made of an elastic material such as rubbers, and has a spirally twisted hole having an elliptical cross section, with which the rotor 224 is engaged. The pitch of the spirally twisted hole of the stator 225 is twice the pitch of the spirally twisted rotor 224. The rotor 224 is engaged with a driving motor 226 via a universal joint 227 and a bearing 228.

In the developer supplying device 200, the developer supplement, which is fed from the container 230 through the developer feeding passage 241*a* of the nozzle 240 and the tube 221 due to the suction power of the screw pump 223, enters into the space formed by the rotor 224 and the stator 225 of the screw pump through a suction entrance 223*a*. The developer supplement thus entering the space is fed from the left side to the right side of the screw pump 223 in FIG. 13. The thus fed developer supplement then falls from a pump exit 223*b*, and thereby the developer supplement is supplied to the developing device 4 via the developer entrance 15*a*.

The developer supplier 220 has the air supplying device 260*a* and 260*b* configured to supply air to the container 230. As illustrated in FIG. 11, airflow passages 244*a* and 244*b* are connected with respective air supplying devices or air pumps 260*a* and 260*b* through air supply passages 261*a* and 261*b*. As illustrated in FIG. 12B, the airflow passages 244*a* and 244*b* are formed between the inner tube 241 and the outer tube 242 to supply air. As illustrated in FIG. 12C, each of the airflow passages 244*a* and 244*b* has a cross section having a semicircular form.

Specific examples of the air pumps include diaphragm air pumps. Air supplied by the air pumps 260*a* and 260*b* is supplied to the container 230 from air supplying openings 246*a* and 246*b* through the air flow passages 244*a* and 244*b*. As illustrated in FIG. 12B, the air supplying openings 246*a* and 246*b* are located below a developer exit 247 of the developer feeding passage 241*a*. Therefore, air supplied by the pumps is supplied to a portion of the developer supplement located in the vicinity of the developer exit 247. Therefore, even when the developer supplement in the container 230 is aggregated because of being left for a long period of time without being used, and thereby the developer exit 247 is clogged, the aggregated developer supplement can be dissociated by the air supplied by the air pumps 260*a* and 260*b*. Accordingly, the developer supplement can be well fed from the container 230 to the developing device 4.

In addition, opening and closing valves 262*a* and 262*b* are provided on the air supply passages 261*a* and 261*b*. The valves 262*a* and 262*b* are opened upon receiving an ON signal from a controller (not shown) to flow air, and are closed upon receiving an OFF signal from the controller to shut out air.

The operation of the developer supplier 220 will be explained by reference to FIG. 11.

When the controller receives a signal from the developing device 4 such that the toner concentration is low, the controller orders the developer supplier 220 to perform a developer supplying operation. Specifically, at first the air pumps 260*a* and 260*b* are operated to supply air to the container 230 while the driving motor 226 of the screw pump 223 is driven to suck the developer supplement in the container 230.

When air is supplied to the container 230 by the air pumps 260*a* and 260*b* through the air supply passages 261*a* and 261*b* and the air passages 244*a* and 244*b*, the developer supplement in the container 230 is agitated and fluidized because of containing air therein. In addition, when air is supplied to the container 230, the internal pressure of the container 230 is increased so as to be higher than the atmospheric pressure. Therefore, the fluidized developer supplement is moved toward the low pressure side. Specifically, the developer supplement in the container 230 is discharged from the developer exit 247. In this example, since the developer supplement is also sucked by the screw pump 223, the developer supplement is smoothly discharged from the developer exit 247.

The developer supplement thus flown out from the container 230 is fed to the screw pump 223 via the developer passage 241*a* and the tube 221. The developer supplement is fed by the screw pump 223 and then falls from the pump exit 223*b*, thereby supplying the developer supplement to the developing device 4 through the developer entrance 15*a*. After a predetermined amount of developer supplement is supplied to the developing device 4, the controller stops the operations of the air pumps 260*a* and 260*b*, and the driving motor 226 while shutting the valves 262*a* and 262*b*. Thus, the developer supplying operation is completed. By shutting the valves 262*a* and 262*b*, occurrence of a problem in that the developer supplement in the container 230 is reversely fed to the air pumps 260*a* and 260*b* can be prevented through the air passages 244*a* and 244*b*.

The amount of air fed by the air pumps 260*a* and 260*b* is controlled so as to be smaller than the amount of air sucked by the screw pump 223. Therefore, as the amount of the developer supplement in the container 230 decreases, the internal pressure of the container 230 is reduced. Since the bag-form container 231 is made of a soft material, the volume of the bag-form container 231 is reduced as the internal pressure thereof is reduced.

FIG. 14 is a schematic perspective view of the bag-form container 231 filled with the developer supplement. FIG. 15 is a schematic front view of the bag-form container 231, which is shrunk because the developer supplement is discharged therefrom. In this regard, it is preferable for the bag-form container 231 to reduce its volume by 60% or more.

The developer supplement contained in the container 230 preferably includes a toner and a carrier (preferably the carrier mentioned above), wherein the content of the carrier in the developer supplement is not less than 3% and less than 30% by weight based on the total weight of the developer supplement. When the content of the carrier is too low, the effect of the supplied carrier is hardly produced. In contrast, when the content is too high, the developer supplement cannot be stably supplied to the developing device.

The toner included in the developer supplement and the developer in the developing device includes at least a binder resin and a colorant, and optionally includes other components such as release agents, and charge controlling agents.

The method for preparing the toner is not particularly limited. For example, pulverization methods including a step of kneading toner components such as binder resins and colorants while heating; cooling the kneaded toner component mixture; pulverizing the cooled toner component mixture; and then classifying the pulverized toner component mixture can be used. In addition, wet methods in which an oil phase liquid is emulsified, suspended or aggregated in an aqueous medium (such as suspension polymerization methods, emulsion polymerization methods and polymer suspension polymerization methods) can be used.

The binder resin of the toner for use in the image forming apparatus of the present invention is not particularly limited, and one or more proper resins are selected from any known resins in consideration of the application of the toner.

Specific examples of the resins include homopolymers of styrene and styrene derivatives such as polystyrene, poly-p-chlorostyrene and polyvinyltoluene; copolymers of styrene and styrene derivatives such as styrene-p-chlorostyrene copolymers, styrene-propylene copolymers, styrene-vinyltoluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, and styrene-maleic acid ester copolymers; other resins such as polymethyl methacrylate, polybutyl methacrylate, polyvinyl chloride, polyvinyl acetate, polyethylene, polyesters, polyurethane resins, epoxy resins, polyvinyl butyral resins, acrylic resins, rosin, modified rosins, terpene resins, phenolic resins, aliphatic or alicyclic hydrocarbon resins, and aromatic petroleum resins; and the like.

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight, based on the total weight of the toner.

Master batches, which are complexes of a colorant with a resin, can be used as the colorant of the toner for use in the present invention.

Specific examples of the resins for use as the binder resin of the master batches include polymers of styrene or styrene derivatives, styrene copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, and the like. These can be used alone or in combination.

The toner for use in the present invention can include a release agent. Known waxes and the like materials can be used as the release agents. Specific examples of the waxes include waxes having a carbonyl group; polyolefin waxes such as polyethylene waxes and polypropylene waxes; long-chain hydrocarbons such as paraffin waxes and SAZOL waxes; and the like.

Among these waxes, waxes having a carbonyl group are preferably used. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkananoic acid esters are preferably used.

The melting point of the release agent for use in the toner is preferably from 40 to 160° C., more preferably from 50 to 120° C., and even more preferably from 60 to 90° C. When the melting point of the release agent is too low, the high temperature preservability of the resultant toner deteriorates. In contrast, when the melting point is too high, the resultant toner tends to cause a cold offset problem in that a toner image adheres to a fixing roller when the toner image is fixed at a relatively low fixing temperature.

The release agent preferably has a melt viscosity of from 5 to 1,000 mPa·s (i.e., 5 to 1,000 cps), and more preferably from 10 to 100 mPa·s (i.e., 10 to 100 cps), at a temperature 20° C. higher than the melting point thereof. Release agents having too high a melt viscosity hardly produce the hot offset resistance improving effect and low temperature fixability improving effect. In contrast, release agents having too low a melt viscosity deteriorates the releasability of the resultant toner.

The content of the release agent in the toner is generally from 1% to 40% by weight, and preferably from 3% to 30% by weight, based on the total weight of the toner. When the content is too high, the fluidity of the toner deteriorates.

A charge controlling agent is typically included in the toner to impart a positive or negative charge to the toner, wherein the polarity is determined depending on the polarity of the charges to be formed on the surface of the image bearing member (e.g., photoreceptors). Suitable materials for use as negative charge controlling agents include resins and compounds having an electron donating group, azo dyes, metal complexes of organic acids, and the like.

Specific examples of the marketed negative charge controlling agents include BONTRON S-31, S-32, S-34, S-36, S-37, S-39, S-40, S-44, E-81, E-82, E-84, E-86, E-88, A, 1-A, 2-A, and 3-A (which are manufactured by Orient Chemical Industries Co., Ltd.); KAYACHARGE N-1 and N-2, and KAYASET BLACK T-2 and 004 (which are manufactured by Nippon Kayaku Co., Ltd.); AIZEN SPIRON BLACK T-37, T-77, T-95, TRH and TNS-2 (which are manufactured by Hodogaya Chemical Co., Ltd.); FCA-1001-N, FCA-1001-NB, and FCA-1001-NZ (which are manufactured by Fujikura Kasei Co., Ltd.); and the like.

Suitable materials for use as positive charge controlling agents include basic compounds such as Nigrosine dyes, cationic compounds such as quaternary ammonium salts, metal salts of high fatty acids, and the like. Specific examples of the marketed positive charge controlling agents include BONTRON N-01, N-02, N-03, N-04, N-05, N-07, N-09, N-10, N-11, N-13, P-51, P-52 and AFP-B (which are manufactured by Orient Chemical Industries Co., Ltd.); TP-302, TP-415, and TP-4040 (which are manufactured by Hodogaya Chemical Co., Ltd.); COPY BLUE PR, and COPY CHARGE PX-VP-435 and NX-VP-434 (which are manufactured by Hoechst A.G.); FCA201, 201-B-1, 201-B-2, 201-B-3, 201-PB, 201-PZ, and 301 (which are manufactured by Fujikura Kasei Co., Ltd.); PLZ 1001, 2001, 6001 and 7001 (which are manufactured by Shikoku Chemicals Corp.); and the like.

These materials can be used alone or in combination.

The content of such charge controlling agents is not unambiguously determined, and is determined depending on the properties of the binder resin used, the method of preparing the toner (including the dispersing method). However, the content is generally from 0.1 to 10 parts by weight, and more preferably from 0.2 to 5 parts by weight, per 100 parts by weight of the binder resin included in the toner. When the content is too high, the charge quantity of the toner excessively increases, thereby increasing the electrostatic attraction between the developing roller and the toner, resulting in deterioration of fluidity of the toner and formation of low density images. In contrast, when the content is too low, the charge rising property and charge quantity of the resultant toner are not sufficient, resulting in deterioration of image qualities.

If desired, the toner can further include one or more additives such as particulate inorganic materials, fluidity improving agents, cleanability improving agents, magnetic materials, metal soaps, and the like.

Specific examples of the particulate inorganic materials include particles of silica, titania, alumina, cerium oxide, strontium titanate, calcium carbonate, magnesium carbonate, and calcium phosphate, and the like, which may be subjected to a hydrophobizing treatment. Among these materials, hydrophobized silica and titanium oxide subjected to a surface treatment are preferably used.

Specific examples of the particulate silica include AEROSIL 130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200, and REA200, which are from Nippon Aerosil Co.; HDK H20, H200, H3004, H2000/4, H2050EP, H2015EP, H3050EP and KHD50, and HVK 2150, which are from Wacker Chemical Co.; CABOSIL L-90, LM-130, LM-150, M-5, PTG, MS-55, H-5, HS-5, EH-5, LM-150D, M-7D, MS-75D, TS-720, TS-610 and TS-530, which are from Cabot Corp.; and the like.

The added amount of such particulate inorganic materials is preferably from 0.1 to 5.0 parts by weight, and more preferably from 0.5 to 3.2 parts by weight, based on 100 parts by weight of the mother toner (i.e., toner particles without an external additive).

The toner for use in the present invention can be prepared by any known methods such as kneading/pulverization methods (dry methods) in which a toner composition mixture is melted and kneaded, followed by cooling, pulverization and classification, and wet methods such as toner composition liquid dispersing methods and polymerization methods.

One example of the kneading/pulverization methods is as follows.

(1) toner constituents such as binder resins, colorants and release agents are mechanically mixed (mixing process);

(2) the mixture is heated and kneaded (kneading process);

(3) the kneaded mixture is cooled and then pulverized (pulverization process); and (4) the pulverized mixture is classified to prepare a mother toner (classification process).

Known mixers can be used for the mixing process. Mixing conditions are not particularly limited, and operations are performed under normal conditions.

The kneading operation is performed using, for example, a kneader such as batch kneaders such as roll mills, and continuous single- or double-axis extruders. Specific examples of the kneaders include KTK double-axis extruders manufactured by Kobe Steel, Ltd., TEM double-axis extruders manufactured by Toshiba Machine Co., Ltd., double-axis extruders manufactured by KCK Co., PCM double-axis extruders manufactured by Ikegai Corp., KO-KNEADER manufactured by Buss AG, and the like.

It is preferable that the kneading operation is performed while controlling the kneading conditions such that the molecular chain of the binder resin used is not cut. For example, the kneading temperature is determined in consideration of the softening point of the binder resin used. Specifically, when the kneading temperature is much higher than the softening point of the binder resin, the molecular chain is seriously cut. In contrast, when the kneading temperature is much lower than the softening point of the binder resin, the dispersion operation cannot be well performed.

In the pulverization process, the kneaded mixture is cooled and then pulverized. In this regard, it is preferable that at first crushing (coarse pulverization) is performed and then fine pulverization is performed. Suitable pulverization methods include jet air pulverization methods in which jet air is applied to the kneaded mixture such that the mixture collides against a collision plate or in which jet air is applied to the kneaded mixture such that particles of the mixture collide against each other, and pulverization methods in which the kneaded mixture is pulverized at a narrow gap formed by a mechanically rotated rotor and a stator.

In the classification process, the pulverized mixture is classified to prepare a mother toner having a desired particle diameter distribution. For example, fine particles are removed from the pulverized mixture using a classifier such as cyclones, decanters, and classifiers using a centrifugal force. In addition, the thus prepared particles are subjected to another classification treatment using a centrifugal force to prepare toner particles (i.e., a mother toner) having a desired particle diameter distribution.

The thus prepared mother toner can be mixed with an external additive, such as particulate inorganic materials (e.g., hydrophobized silica), to improve the fluidity, preservability, developing property and transferring property.

An external additive can be mixed with the mother toner using a known mixer for mixing powders. In this regard, it is preferable to use a mixer which is equipped with a jacket to control the internal temperature of the mixing vessel. In order to apply a proper stress to the external additive and the mother toner, the following methods can be used:

(1) the external additive is gradually added to the mother toner or is added from a middle of the mixing operation;

(2) the rotation speed (or rolling speed), mixing time and mixing temperature are properly controlled; or (3) at first a strong stress is applied, followed by application of weak stress, or vice versa.

Suitable mixers for use in the external additive mixing process include V-form mixers, rocking mixers, LOEDGE MIXER, NAUTER MIXER, HENSCEL MIXER, and the like.

The thus prepared particles are sieved to remove coarse particles and aggregated particles, resulting in formation of toner.

The wet toner preparation methods will be explained below by reference to specific examples.

As mentioned above, the developer supplement in the container and the developer in the developing device include such a toner as mentioned above and such a carrier as mentioned above by reference to FIG. 4. Therefore, even when the developer is used for a long period of time, occurrence of the problems in that the cover layer of the carrier is abraded and spent toner is adhered to the surface of the carrier can be prevented. Thereby, decrease of the charge quantity of the developer in the developing device and decrease of the electric resistance of the carrier can be prevented. Thus, the developer can maintain good developing ability for a long period of time.

The image forming apparatus of the present invention is not limited to the above-mentioned image forming apparatus, and image forming apparatus having similar functions can also be used as the image forming apparatus of the present invention.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Preparation Example 1

Synthesis of Binder Resin

The following components were contained in a reaction container having a condenser, an agitator and a nitrogen feed pipe and reacted for 8 hours at 230° C. under normal pressure.

| | |
|---|---|
| Ethylene oxide adduct (2 mole) of bisphenol A | 724 parts |
| Isophthalic acid | 276 parts |
| Dibutyl tin oxide | 2 parts |

The reaction was further continued for 5 hours under a reduced pressure of from 10 to 15 mmHg (1.33 to 2.0 Pa), followed by cooling to 160° C. Further, 32 parts of phthalic anhydride was added thereto to perform a reaction for 2 hours at 160° C. After the reaction product was cooled to 80° C., the reaction product was reacted with 188 parts of isophorone diisocyanate in ethyl acetate for 2 hours. Thus, a prepolymer P1 having an isocyanate group was prepared.

Next, 267 parts of the prepolymer P1 and 14 parts of isophorone diamine were reacted for 2 hours at 50° C. in ethyl acetate. Thus, a urea-modified polyester U1 having a weight average molecular weight of 64,000 was prepared.

In addition, the following components were contained in a reaction container having a condenser, an agitator and a nitrogen introducing tube and reacted for 8 hours at 230° C. under normal pressure.

| | |
|---|---|
| Ethylene oxide adduct (2 mole) of bisphenol A | 724 parts |
| Terephthalic acid | 276 parts |

The reaction was further continued for 5 hours under a reduced pressure of from 10 to 15 mmHg (1.33 to 2.0 Pa). Thus, an unmodified polyester E1 having a weight average molecular weight of 5,000 was prepared.

Next, 200 parts of the urea-modified polyester U1 and 800 parts of the unmodified polyester E1 were dissolved in 2,000 parts of a mixture solvent of ethyl acetate and methyl ethyl ketone (mixed at a ratio of 1/1). Thus, an ethyl acetate/methyl ethyl ketone solution of a binder resin (mixture of U1 and E1) was prepared.

Part of the solution was dried to obtain the dry binder resin B1. It was confirmed that the binder resin B1 has a glass transition temperature (Tg) of 62° C.

Preparation of Master Batch

1. Preparation of Polyester Resin A

The following components were contained in a 1-liter four neck flask equipped with a thermometer, an agitator, a condenser, and a nitrogen feed pipe.

| | |
|---|---|
| Terephthalic acid | 60 parts |
| Dodecenylsuccinic anhydride | 25 parts |
| Trimellitic anhydride | 15 parts |
| Propylene oxide (2.2) adduct of bisphenol A | 70 parts |
| Ethylene oxide (2.2) adduct of bisphenol A | 50 parts |

Then the flask was set on a mantle heater. After nitrogen gas was fed into the flask so that the inside of the flask is in an inert gas environment, the components were heated. Next, 0.05 parts of dibutyl tin oxide was added thereto, and the mixture was heated at 200° C. Thus, a polyester resin A was prepared. It was confirmed that the polyester resin A has a peak molecular weight of 4,200 and a glass transition temperature (Tg) of 59.4° C.

2. Preparation of Master Batch

The following components were mixed using a HENSCHEL MIXER mixer.

| | |
|---|---|
| C.I. Pigment Yellow 155 (Pigment) | 40 parts |
| Polyester resin A prepared above (Binder resin) | 60 parts |
| Water | 30 parts |

Thus, a mixture in which water penetrates into the aggregated pigment was prepared. The mixture was kneaded for 45 minutes using a two-roll mill heated to 130° C. The kneaded mixture was then pulverized with a pulverizer so as to have a diameter of about 1 mm. Thus, a master batch M1 was prepared.

Preparation of Toner

The following components were mixed at 60° C. in a beaker using a TK HOMOMIXER mixer, whose rotor was rotated at a revolution of 12,000 rpm to prepare a toner composition liquid.

| | |
|---|---|
| Ethyl acetate/methyl ethyl ketone solution of binder resin B1 prepared above | 240 parts |
| Pentaerythritol tetrabehenate (melting point of 81° C., melt viscosity of 25 cps) | 20 parts |
| Master batch M1 prepared above | 8 parts |

On the other hand, the following components were contained in a beaker and mixed.

| | |
|---|---|
| Ion-exchange water | 706 parts |
| 10% aqueous dispersion of hydroxyapatite (SUPERTITE 10 from Nippon Chemical Industrial Co., Ltd.) | 294 parts |
| Sodium dodecylbenzenesulfonate | 0.2 parts |

After being heated to 60° C., the mixture was agitated using TK HOMOMIXER, whose rotor was rotated at a revolution of 12,000 rpm. Thus, an aqueous phase liquid was prepared.

Next, the toner composition liquid prepared above was added to the aqueous phase liquid while the mixture was agitated for 10 minutes using the TK HOMOMIXER mixer. The mixture was then heated to 98° C. to remove the solvent (i.e., ethyl acetate and methyl ethyl ketone). The thus prepared dispersion was then subjected to filtration, washing, drying and air-classification treatments. As a result, colored particles (i.e., mother toner) were prepared.

The following components were mixed using a HENSCHEL MIXER mixer.

| | |
|---|---|
| Colored particles prepared above | 100 parts |
| Hydrophobized silica | 1 part |
| Hydrophobized titanium oxide | 1 part |

Thus, a toner A was prepared.

Thus, a toner A was prepared.

An ultrathin section of the toner A was prepared to be observed by a transmission electron microscope H-9000H of 100,000 power magnification from Hitachi Ltd. Specifically, the particle diameters of randomly selected 100 particles of the colorant (Pigment Yellow 155) dispersed in the cross section of the toner were measured, and the average thereof was determined. In this regard, the diameter of a particle is defined as the average of the longest diameter and the shortest diameter of the particle, and aggregated particles are defined as one particle. As a result of the observation, it was confirmed that the average particle diameter of the colorant dispersed in the toner is 0.40 μm, and the percentage of particles having a particle diameter of not smaller than 0.7 μm is 4.5%.

The volume average particle diameter (Dv) and number average particle diameter (Dn) of the toner A, which were determined using an instrument COULTER COUNTER TA2 (from Beckman Coulter Inc.) with an aperture of 100 μm, were 6.2 μm and 5.1 μm, respectively.

The average circularity of the toner A was measured using a flow particle image analyzer FPIA-2000 from Sysmex Corp. The procedure is as follows:

(1) at first 100 to 150 ml of water, from which solid foreign materials have been removed, 0.1 to 0.5 ml of a surfactant (alkylbenzenesulfonate) and 0.1 to 0.5 g of a sample (i.e., toner) are mixed to prepare a dispersion;

(2) the dispersion is further subjected to a supersonic dispersion treatment for 1 to 3 minutes using a supersonic dispersion machine to prepare a dispersion including particles at a concentration of from 3,000 to 10,000 pieces/μl;

(3) the dispersion is passed through a detection area formed on a plate in the instrument; and (4) the particles are optically detected by a CCD camera and then the shapes thereof are analyzed with an image analyzer to determine the average circularity of the sample.

As a result, the average circularity of the toner A was 0.96.

Carrier Preparation Example 1

The following components were mixed for 10 minutes using a HOMOMIXER mixer from Tokushu Kika Kogyo Co., Ltd. to prepare a carrier coating liquid.

| | |
|---|---|
| Acrylic resin solution (solid content of 50% by weight) | 2130 parts |
| Aminosilane ($H_2N(CH_2)_2Si(OC_2H_5)_3$) (solid content of 100% by weight) | 4 parts |
| Particualte silica A (volume average particle diameter of 0.35 μm) | 1300 parts |
| Toluene | 6000 parts |

A ferrite powder which serves as a core material of the carrier and which has a volume average particle diameter (Dv) of 35 μm was coated with the coating liquid prepared above using a coating machine SPIRA COTA from Okada Seiko Co., Ltd. under conditions of 55° C. in treatment temperature and 30 g/min in treatment speed. The thickness of the cover layer was 0.15 μm. The coated carrier was then calcined for 1 hour at 150° C. using an electric furnace. After cooling, the coated carrier was sieved using a screen with openings of 100 μm. Thus, a coated carrier I, which has a cover layer having an average thickness T (defined in FIG. 4) of 0.40 μm, was prepared.

The volume average particle diameter (Dv) of the core material was measured with a particle analyzer, MICROTRACK SRA from Nikkiso Co., Ltd. under a condition of from 0.7 μm to 125 μm in measurement particle range.

As mentioned above, the resinous portion of the average thickness h (μm) of the cover layer was determined as follows. Specifically, the cross section of the carrier particle is observed with a transmission electron microscope. Then the thicknesses (ha, hb, hc or hd illustrated in FIG. 4) of the cover layer are measured at regular intervals of 0.2 μm along the surface of the carrier. The average thickness h of the resinous portion is determined by averaging 50 thickness data thus obtained. In this regard, each data for any one of the thicknesses ha, hb, hc, and hd is counted as one data. In addition, the average thickness T (μm) of the cover layer (i.e., the average length of from the surface of the core material and the surface of the cover layer) was similarly determined using the transmission electron microscope. Specifically, the thicknesses T of the cover layer are measured at regular intervals of 0.2 μm along the surface of the carrier. The average thickness T of the cover layer is determined by averaging 50 thickness data thus obtained.

Carrier Preparation Example 2

The procedure for preparation of the carrier I in Carrier Preparation Example 1 was repeated except that the particulate silica A was replaced with a particulate silica B having an average particle diameter of 0.12 μm.

Thus, a coated carrier II, which has a cover layer having an average thickness T of 0.21 μm, was prepared.

Carrier Preparation Example 3

The procedure for preparation of the carrier I in Carrier Preparation Example 1 was repeated except that the particulate silica A was replaced with a particulate silica C having an average particle diameter of 1.55 μm.

Thus, a coated carrier III, which has a cover layer having an average thickness T of 1.04 μm, was prepared.

Carrier Preparation Example 4

The procedure for preparation of the carrier I in Carrier Preparation Example 1 was repeated except that the particulate silica A was replaced with a particulate alumina A having an average particle diameter of 0.37 μm.

Thus, a coated carrier IV, which has a cover layer having an average thickness T of 0.40 μm, was prepared.

Carrier Preparation Example 5

The procedure for preparation of the carrier I in Carrier Preparation Example 1 was repeated except that the formula of the cover layer coating liquid was changed as follows.

| | |
|---|---|
| Acrylic resin solution (solid content of 50% by weight) | 2130 parts |
| Aminosilane ($H_2N(CH_2)_2Si(OC_2H_5)_3$) (solid content of 100% by weight) | 4 parts |
| Particualte alumina A (volume average particle diameter of 0.37 μm) | 1300 parts |
| Particulate zinc oxide A (volume average particle diameter of 0.020 μm) | 500 parts |
| Toluene | 6000 parts |

Thus, a coated carrier V, which has a cover layer having an average thickness T of 0.42 μm, was prepared.

Carrier Preparation Example 6

The procedure for preparation of the carrier I in Carrier Preparation Example 1 was repeated except that the formula of the cover layer coating liquid was changed as follows.

| | |
|---|---|
| Acrylic resin solution (solid content of 50% by weight) | 2130 parts |
| Aminosilane ($H_2N(CH_2)_2Si(OC_2H_5)_3$) (solid content of 100% by weight) | 4 parts |
| Particualte alumina A (volume average particle diameter of 0.37 μm) | 1300 parts |
| Particulate titanium oxide A (volume average particle diameter of 0.015 μm) | 500 parts |
| Toluene | 6000 parts |

Thus, a coated carrier VI, which has a cover layer having an average thickness T of 0.41 μm, was prepared.

Carrier Preparation Example 7

The procedure for preparation of the carrier I in Carrier Preparation Example 6 was repeated except that the coating weight of the cover layer coating liquid was changed so that the average thickness h of the resinous layer is 0.05 μm.

Thus, a coated carrier VII, which has a cover layer having an average thickness T of 0.09 μm, was prepared.

Carrier Preparation Example 8

The procedure for preparation of the carrier I in Carrier Preparation Example 6 was repeated except that the particulate alumina A was replaced with a particulate alumina B having a volume average particle diameter of 1.54 μm, and the coating weight of the cover layer coating liquid was changed so that the average thickness h of the resinous layer is 1.51 μm.

Thus, a coated carrier VIII, which has a cover layer having an average thickness T of 3.03 μm, was prepared.

Carrier Preparation Example 9

The procedure for preparation of the carrier I in Carrier Preparation Example 1 was repeated except that the formula of the cover layer coating liquid was changed to the following.

| | |
|---|---|
| Acrylic resin solution (solid content of 50% by weight) | 1500 parts |
| Silicone resin solution (prepared by diluting a silicone resin solution SR2411 from Dow Corning Toray Silicone Co., Ltd. to have a solid content of 20% by weight) | 1575 parts |
| Aminosilane ($H_2N(CH_2)_2Si(OC_2H_5)_3$) (solid content of 100% by weight) | 4 parts |
| Particualte alumina A (volume average particle diameter of 0.37 μm) | 1300 parts |
| Particulate titanium oxide A (volume average particle diameter of 0.015 μm) | 500 parts |
| Toluene | 6000 parts |

Thus, a coated carrier IX, which has a cover layer having an average thickness T of 0.41 μm, was prepared.

Carrier Preparation Example 10

The procedure for preparation of the carrier I in Carrier Preparation Example 1 was repeated except that the formula of the cover layer coating liquid was changed to the following.

| | |
|---|---|
| Acrylic resin solution (solid content of 50% by weight) | 1500 parts |
| Guanamine solution (MYCOAT 106 from Mitsui-Cytec Co., Ltd. (MT AquaPolymer Inc.), solid content of 70% by weight) | 450 parts |
| Aminosilane ($H_2N(CH_2)_2Si(OC_2H_5)_3$) (solid content of 100% by weight) | 4 parts |
| Particualte alumina A (volume average particle diameter of 0.37 μm) | 1300 parts |
| Particulate titanium oxide A (volume average particle diameter of 0.015 μm) | 500 parts |
| Toluene | 6000 parts |

Thus, a coated carrier X, which has a cover layer having an average thickness T of 0.41 μm, was prepared.

In this regard, the particulate titanium oxide A used for Carrier Preparation Examples 6-10 is not subjected to a surface treatment.

Example 1

The following components were mixed for 10 minutes using a mixer to prepare a developer (initial developer) to be contained in the developing device 4 or 3.

| | |
|---|---|
| Toner A prepared above | 7 parts |
| Carrier I prepared above | 93 parts |

In addition, the following components were mixed for 10 minutes using a mixer to prepare a developer supplement to be contained in the container 230.

| | |
|---|---|
| Toner A prepared above | 80 parts |
| Carrier I prepared above | 20 parts |

The thus prepared developer (and developer supplement) was evaluated with respect to the following properties.

1. Clearness of Image

The developer and the developer supplement prepared in Example 1 were set in a digital full color printer, IMAGIO NEO C600PRO from Ricoh Co., Ltd., which had been modified to have the developer supplying device illustrated in FIG. 10 and the developing device 4 illustrated in FIG. 7, and copies of an original character image including characters of about 2 mm long and 2 mm wide at an image area proportion of 5% were produced.

The copies were visually observed to evaluate the reproducibility of the character images (i.e., clearness of the images). Specifically the images were graded as follows.

◎: The reproducibility (clearness) is excellent.

○: The reproducibility (clearness) is good.

Δ: The reproducibility (clearness) is acceptable.

X: The reproducibility (clearness) is unacceptable.

2. Durability of Developer

A running test in which the above-mentioned image forming operation is repeated to produce 150,000 copies was performed. The charge quantity of the toner and the resistivity of the carrier were measured before and after the running test to determine decrease of the charge quantity and change of the volume resistivity of the carrier.

Decrease of the charge quantity of the toner is determined by the following method.

At first, the initial developer prepared above, which includes the toner and the carrier in a weight ratio of 7/93, is frictionally charged, and then subjected to a blow-off treatment using an instrument TB-200 from Toshiba Chemical Corp. to determine the initial charge quantity of the toner. After the running test, the developer is subjected to the blow-off treatment to obtain the carrier used for the running test. The carrier is then mixed with a fresh toner (which is the same as the toner used for the initial developer) in a weight ratio of 93/7, and the developer is frictionally charged under the same conditions as those for the initial developer, and then subjected to the blow-off treatment to determine the charge quantity of the toner and to determine the difference between the initial charge quantity and the charge quantity after the running test. Decrease of the charge quantity is mainly caused by adhesion of spent toner to the surface of the carrier. It is preferable to remove the cause in order to prevent decrease of the charge quantity of the toner. The target of decrease of the charge quantity is not greater than 10.0 μC/g.

Decrease of the volume resistivity of the carrier is determined by the following method.

At first, the initial carrier to be used for the initial developer is fed into a gap of 2 mm formed by two opposed electrodes of a resistivity measuring instrument. A DC voltage of 1000V is applied between the electrodes, and the current flowing the electrodes 30 seconds after the input of the voltage is measured to determine the initial resistance of the carrier. The initial volume resistivity of the carrier is calculated from the initial resistance. Next, the developer used for the running test is subjected to the blow-off treatment to obtain the carrier used for the running test. The volume resistivity of the carrier used for the running test is also determined by the same method as mentioned above to determine the difference between the initial volume resistivity and the volume resistivity of the carrier used for the running test. The target of the difference (logarithmic difference) in units of (log(Ω·cm)) is not greater than 3.0. Change of the volume resistivity of the carrier is mainly caused by abrasion of the cover layer, adhesion of spent toner to the surface of the carrier, and release of the larger particles from the cover layer. Therefore, it is preferable to remove the causes in order to decrease the change of the volume resistivity of the carrier.

3. Image Quality (Evenness of Image Density)

After the running test mentioned above, a solid image was produced. The solid image was visually observed to determine whether the image has even image density. The images are graded as follows.

◎: The image has completely even image density.

○: The image has slightly uneven image density, but the image is acceptable.

Δ: The image has uneven image density, but the image is still acceptable.

X: The image has so seriously uneven image density that the developer cannot be practically used.

In addition, after the running test, the 150,000$^{th}$ copy was visually observed to determine whether the image has background fouling (i.e., whether the background of the image is soiled with the toner). The images are graded as follows with respect to background fouling.

◎: The image has no background fouling.

○: The image has slight background fouling, but the image is acceptable.

Δ: The image has background fouling, but the image is still acceptable.

X: The image has so serious background fouling that the developer cannot be practically used.

Comparative Example 1

The procedure for preparation and evaluation of the developer in Example 1 was repeated except that the developer supplying device illustrated in FIG. 10 was not attached to the copier (IMAGIO NEO C600PRO), and the running test was performed while supplying only the toner to the developing device.

Comparative Example 2

The procedure for preparation and evaluation of the developer in Example 1 was repeated except that the developing device (illustrated in FIG. 7) attached to the copier (IMAGIO NEO C600PRO) was replaced with a developing device in which the developer used for developing is returned to the developer supplying passage.

Comparative Examples 3 and 4 and Examples 2-8

The procedure for preparation and evaluation of the developer in Example 1 was repeated except that the carrier was replaced with one of the carriers II to X.

Example 9

The procedure for preparation and evaluation of the developer in Example 8 was repeated except that the developer supplement was changed to the following.

| | |
|---|---|
| Toner A prepared above | 98 parts |
| Carrier X prepared above | 2 parts |

Example 10

The procedure for preparation and evaluation of the developer in Example 8 was repeated except that the developer supplement was changed to the following.

| | |
|---|---|
| Toner A prepared above | 69 parts |
| Carrier X prepared above | 31 parts |

Example 11

The procedure for preparation and evaluation of the developer in Example 8 was repeated except that the developer contained in the developing device was changed to the following.

| | |
|---|---|
| Toner A prepared above | 16 parts |
| Carrier X prepared above | 84 parts |

Example 12

The procedure for preparation and evaluation of the developer in Example 8 was repeated except that the developer contained in the developing device was changed to the following.

| | |
|---|---|
| Toner A prepared above | 1 part |
| Carrier X prepared above | 99 parts |

Examples 13-24 and Comparative Examples 5 and 6

The procedure for preparation and evaluation of the developers in Examples 1-12 and Comparative Example 3 and 4 was repeated except that the developing device illustrated in FIG. 16 was used for the copier instead of the developing device illustrated in FIG. 7.

Figure 2:
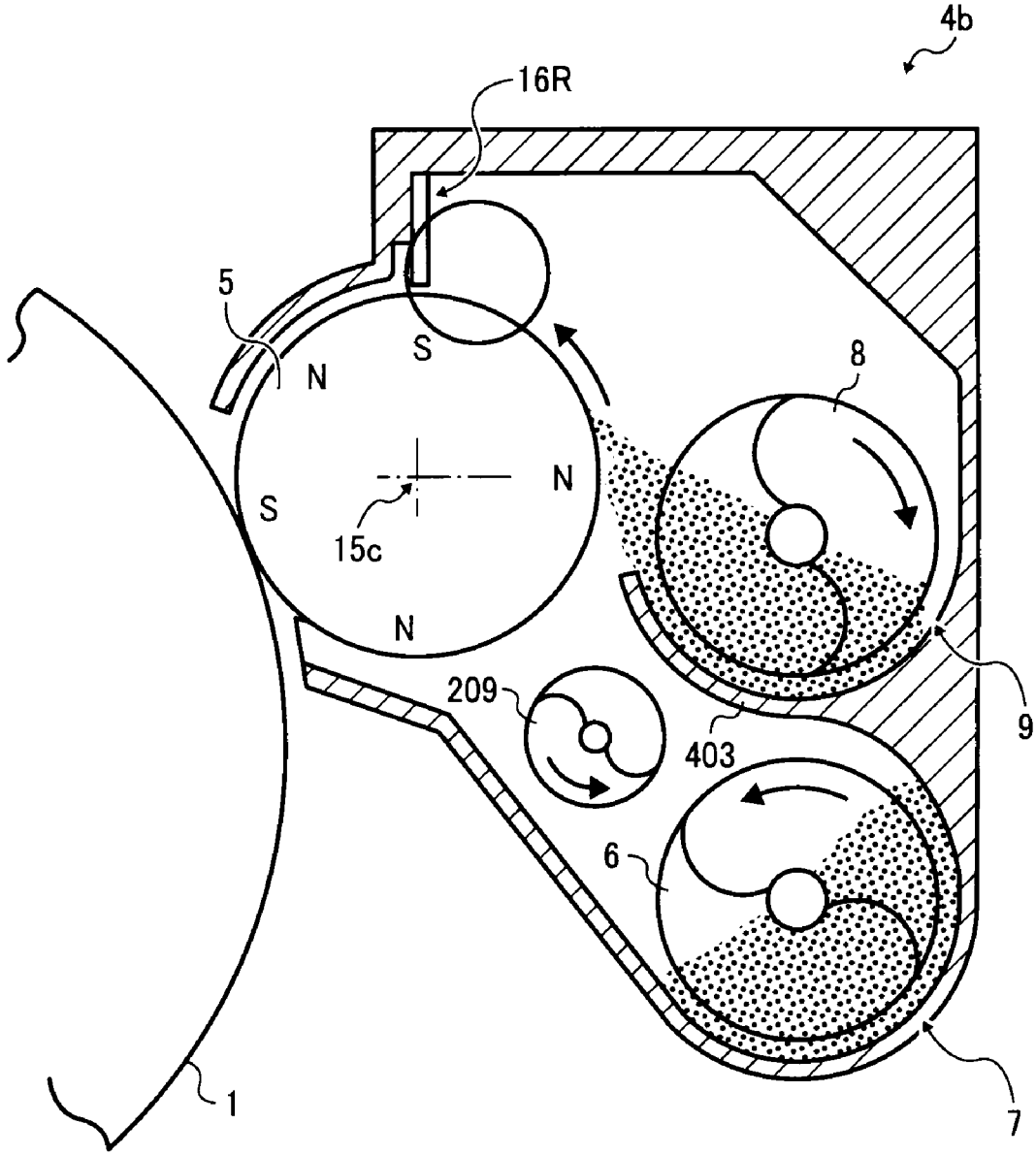
FIG. 2 BACKGROUND ART
Figure 3:
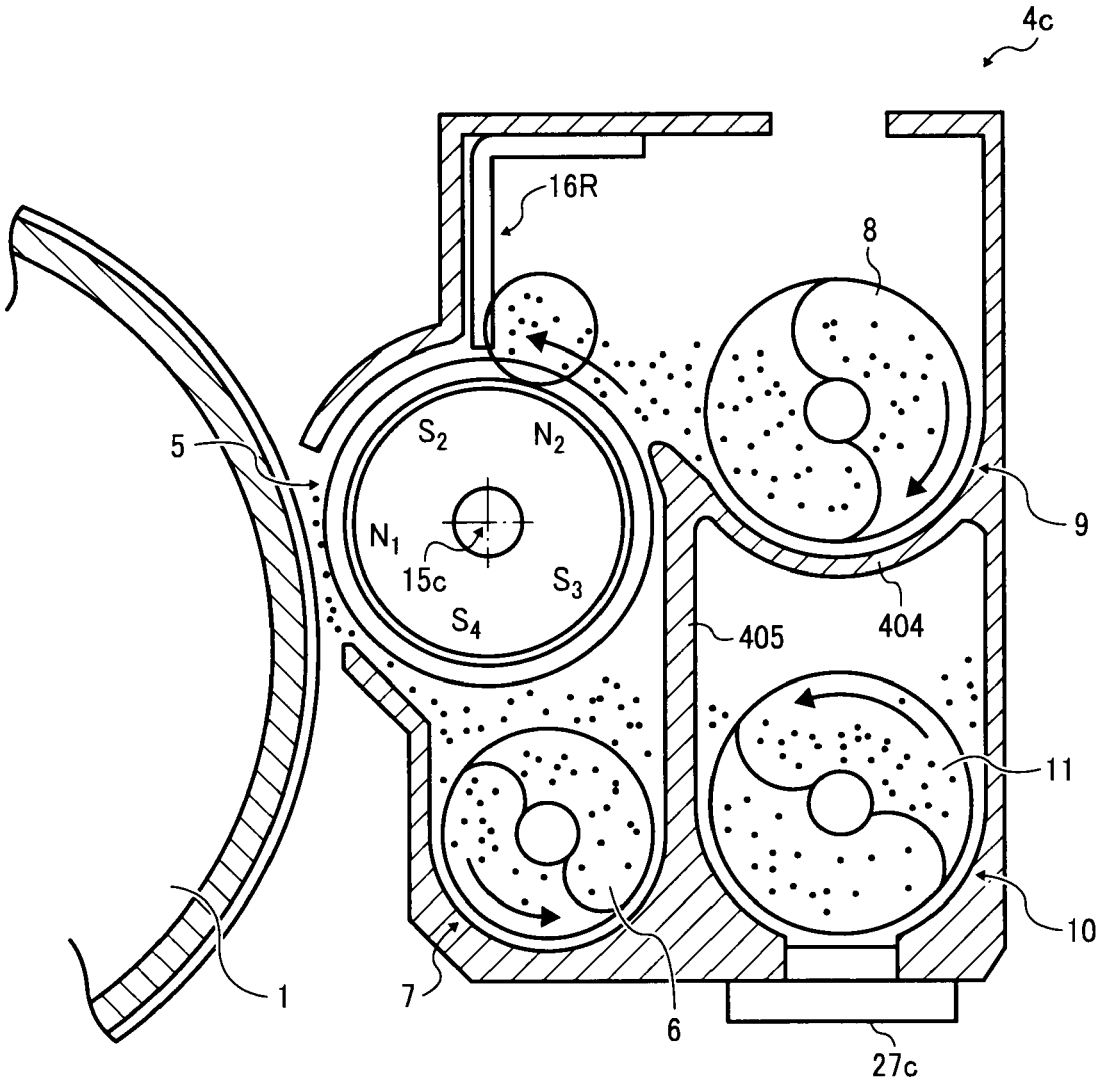
FIG. 3 BACKGROUND ART

The details of the carriers used for Examples 1-24 and Comparative Examples 1-6 are illustrated in FIGS. 1-1 and 1-2.

TABLE 1-1

| | Carrier | Average thickness h (μm) | First particulate material | D1 (μm) | D1/h |
|---|---|---|---|---|---|
| Exs. 1-13 and Comp. Exs. 1-2 | I | 0.15 | Silica A | 0.35 | 2.33 |
| Comp. Exs. 3 and 5 | II | 0.15 | Silica B | 0.12 | 0.80 |
| Comp. Exs. 4 and 6 | III | 0.15 | Silica C | 1.55 | 10.33 |
| Exs. 2 and 14 | IV | 0.15 | Alumina A | 0.37 | 2.47 |
| Exs. 3 and 15 | V | 0.15 | Alumina A | 0.37 | 2.47 |
| Exs. 4 and 16 | VI | 0.15 | Alumina A | 0.37 | 2.47 |
| Exs. 5 and 17 | VII | 0.05 | Alumina A | 0.37 | 7.40 |
| Exs. 6 and 18 | VIII | 1.51 | Alumina B | 1.54 | 1.02 |
| Exs. 7 and 19 | IX | 0.15 | Alumina A | 0.37 | 2.47 |
| Exs. 8-12 and Comp. Exs. 20-24 | X | 0.15 | Alumina A | 0.37 | 2.47 |

TABLE 1-2

| | Second particulate material | D2 (μm) | D2/h | Average thickness T (μm) | Binder resin |
|---|---|---|---|---|---|
| Exs. 1-13 and Comp. Exs. 1-2 | — | — | — | 0.40 | Acrylic resin |
| Comp. Exs. 3 and 5 | — | — | — | 0.21 | Acrylic resin |
| Comp. Exs. 4 and 6 | — | — | — | 1.04 | Acrylic resin |
| Exs.2 and 14 | — | — | — | 0.40 | Acrylic resin |
| Exs. 3 and 15 | Zinc oxide | 0.020 | 0.13 | 0.41 | Acrylic resin |
| Exs. 4 and 16 | Titanium oxide | 0.015 | 0.10 | 0.41 | Acrylic resin |
| Exs. 5 and 17 | Titanium oxide | 0.015 | 0.30 | 0.41 | Acrylic resin |
| Exs. 6 and 18 | Titanium oxide | 0.015 | 0.01 | 3.03 | Acrylic resin |
| Exs. 7 and 19 | Titanium oxide | 0.015 | 0.10 | 0.41 | Acrylic resin + Silicone resin |
| Exs. 8-12 and Comp. Exs. 20-24 | Titanium oxide | 0.015 | 0.10 | 0.41 | Acrylic resin + amino resin |

The results of the evaluation are shown in Tables 2-1 and 2-2.

TABLE 2-1

| | Initial charge quantity (μC/g) | Decrease of charge quantity (μC/g) | Initial Volume resistivity log(Ω · cm) | Change of Volume resistivity log(Ω · cm) |
|---|---|---|---|---|
| Ex. 1 | 32.1 | 8.8 | 13.4 | 2.6 |
| Comp. Ex. 1 | 32.1 | 13.2 | 13.4 | 4.1 |
| Comp. Ex. 2 | 32.1 | 8.7 | 13.4 | 2.4 |
| Comp. | 33.4 | 10.2 | 13.7 | 3.2 |

TABLE 2-1-continued

| | Initial charge quantity (μC/g) | Decrease of charge quantity (μC/g) | Initial Volume resistivity log(Ω · cm) | Change of Volume resistivity log(Ω · cm) |
|---|---|---|---|---|
| Ex. 3 | | | | |
| Comp. Ex. 4 | 29.7 | 11.9 | 12.5 | 4.5 |
| Ex. 2 | 33.3 | 8.1 | 13.5 | 2.3 |
| Ex. 3 | 31.7 | 7.2 | 13.0 | 1.9 |
| Ex. 4 | 31.5 | 6.8 | 12.9 | 1.7 |
| Ex. 5 | 28.3 | 8.6 | 12.1 | 2.7 |
| Ex. 6 | 34.2 | 4.2 | 13.9 | 0.9 |
| Ex. 7 | 31.8 | 4.4 | 13.1 | 1.0 |
| Ex. 8 | 31.9 | 4.3 | 13.2 | 1.1 |
| Ex. 9 | 31.9 | 9.0 | 13.2 | 2.8 |
| Ex. 10 | 31.9 | 4.5 | 13.2 | 1.2 |
| Ex. 11 | 24.1 | 4.7 | 13.2 | 1.1 |
| Ex. 12 | 35.8 | 4.1 | 13.2 | 1.3 |
| Ex. 13 | 32.1 | 8.5 | 13.4 | 2.4 |
| Comp. Ex. 5 | 33.4 | 10.1 | 13.7 | 3.1 |
| Comp. Ex. 6 | 29.7 | 11.6 | 12.5 | 4.3 |
| Ex. 14 | 33.3 | 7.8 | 13.5 | 2.1 |
| Ex. 15 | 31.7 | 6.8 | 13.0 | 1.7 |
| Ex. 16 | 31.5 | 6.3 | 12.9 | 1.4 |
| Ex. 17 | 28.3 | 8.3 | 12.1 | 2.5 |
| Ex. 18 | 34.2 | 3.9 | 13.9 | 0.6 |
| Ex. 19 | 31.8 | 4.1 | 13.1 | 0.7 |
| Ex. 20 | 31.9 | 4.0 | 13.2 | 0.8 |
| Ex. 21 | 31.9 | 8.6 | 13.2 | 2.5 |
| Ex. 22 | 31.9 | 4.1 | 13.2 | 0.9 |
| Ex. 23 | 24.1 | 4.3 | 13.2 | 0.8 |
| Ex. 24 | 35.8 | 3.8 | 13.2 | 1.0 |

TABLE 2-2

| | Clearness | Evenness of image density | Background fouling |
|---|---|---|---|
| Ex. 1 | ◎ | ○ | Δ |
| Comp. Ex. 1 | ◎ | ○ | X |
| Comp. Ex. 2 | ◎ | X | Δ |
| Comp. Ex. 3 | ○ | X | X |
| Comp. Ex. 4 | Δ | ○ | X |
| Ex. 2 | ◎ | ○ | Δ |
| Ex. 3 | ◎ | ○ | ○ |
| Ex. 4 | ◎ | ○ | ○ |
| Ex. 5 | ◎ | ○ | Δ |
| Ex. 6 | ○ | ○ | ○ |
| Ex. 7 | ◎ | ○ | ◎ |
| Ex. 8 | ◎ | ○ | ◎ |
| Ex. 9 | ◎ | Δ | Δ |
| Ex. 10 | ◎ | Δ | ○ |
| Ex. 11 | Δ | Δ | ○ |
| Ex. 12 | Δ | Δ | ○ |
| Ex. 13 | ◎ | ◎ | Δ |
| Comp. Ex. 5 | ○ | X | X |
| Comp. Ex. 6 | Δ | ◎ | X |
| Ex. 14 | ◎ | ◎ | Δ |
| Ex. 15 | ◎ | ◎ | ○ |
| Ex. 16 | ◎ | ◎ | ○ |
| Ex. 17 | ◎ | ◎ | Δ |
| Ex. 18 | ○ | ◎ | ○ |
| Ex. 19 | ◎ | ◎ | ◎ |
| Ex. 20 | ◎ | ◎ | ◎ |
| Ex. 21 | ◎ | ◎ | Δ |
| Ex. 22 | ◎ | Δ | ○ |

TABLE 2-2-continued

| | Clearness | Evenness of image density | Background fouling |
|---|---|---|---|
| Ex. 23 | Δ | ○ | ○ |
| Ex. 24 | Δ | ○ | ○ |

It is found from Table 2-2 that the images produced by a two-passage one-way circulation developing device (Examples 13-24) are superior in evenness of image density to the images produced by a three-passage one-way circulation developing device (Examples 1-12).

The reason why the evenness of the images produced in Examples 9, 10 and 22 is slightly worse than the images produced in Examples 8 and 20 is that the feedability of the developer supplements used in Examples 9, 10 and 22 is worse than that of the developer supplements used in Examples 8 and 20.

The reason why the evenness of the image produced in Comparative Example 2 is worse is that a conventional developing device in which the developer used for developing is returned to the developer supplying passage was used.

The reason why the evenness of the images produced in Comparative Examples 3 and 5 is worse is that the ratio D1/h of the cover layer of the carrier is not greater than 1 and therefore the effect of the first particulate material is not well produced.

It is found from comparison with Example 8 with Examples 11 and 12 and comparison with Example 20 with Examples 23 and 24 that when the toner concentration in the developer is too high or low, the image qualities deteriorate.

This document claims priority and contains subject matter related to Japanese patent applications Nos. 2007-238424 and 2008-197829, filed on Sep. 13, 2007, and Jul. 31, 2008, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member configured to bear an electrostatic latent image thereon;

a developing device, which is configured to develop the electrostatic latent image with a developer including a toner and a carrier to form a toner image on the image bearing member and which includes:

a developer bearing member configured to bear the developer to develop the electrostatic latent image with the developer at a development region;

a developer containing portion configured to contain the developer;

a developer supplying passage including a developer feeding member configured to feed the developer in a first direction parallel to an axial direction of the developer bearing member to supply the developer to the developer bearing member; and a developer agitating passage including a developer agitating member configured to feed a mixture of the developer, which is fed to a downmost stream side of the developer supplying passage without being used for developing the electrostatic latent image, and the developer, which passes through the development region and is directly returned to the developer agitating passage, in a second direction opposite to the first direction to an upstream side of the developer supplying passage while agitating the mixed developer, wherein the developer agitating passage is separated with a partition from the developer supplying passage except for at least both end portions thereof in the first and second directions;

a developer supplement supplying device configured to supply a developer supplement including the toner and the carrier to the developing device to mix the developer supplement with the mixed developer; and a developer discharging device configured to discharge an excess of the developer from the developing device to replace at least a part of the carrier in the developer with the carrier in the developer supplement, wherein the carrier includes a particulate core material and a cover layer located on the surface of the particulate core material, and wherein the cover layer includes a binder resin and a first particulate material, wherein the cover layer satisfies the following relationship:

$$1<(D1/h)<10,$$

wherein D1 represents a volume average particle diameter of the first particulate material in units of micrometer, and h represents an average thickness of a resinous portion of the cover layer in units of micrometer.

2. The image forming apparatus according to claim 1, wherein the first particulate material includes alumina.

3. The image forming apparatus according to claim 1, wherein the cover layer further includes a second particulate material, and wherein the cover layer further satisfies the following relationship:

$$0.001<(D2/h)<1,$$

wherein D2 represents a volume average particle diameter of the second particulate material in units of micrometer, and h represents the average thickness of the resinous portion of the cover layer in units of micrometer.

4. The image forming apparatus according to claim 3, wherein the second particulate material includes titanium oxide.

5. The image forming apparatus according to claim 1, wherein the cover layer further satisfies the following relationship:

$$0.1\leqq T\leqq 3.0,$$

wherein T represents an average thickness of the cover layer in units of micrometer.

6. The image forming apparatus according to claim 1, wherein the binder resin includes one member selected from reaction products of an acrylic resin and an amino resin, and silicone resins.

7. The image forming apparatus according to claim 1, wherein the developer supplement includes the carrier in an amount of not less than 3% by weight and less than 30% by weight based on a total weight of the developer supplement.

8. The image forming apparatus according to claim 1, wherein the developer contained in the developing device includes the carrier in an amount of from 85 to 98% by weight based on a total weight of the developer in the developing device.

9. The image forming apparatus according to claim 1, wherein the developer supplement supplying device includes a deformable container containing the developer supplement and deforming as the developer supplement is discharged therefrom, and a suction pump configured to suck the developer supplement in the deformable container and feed the developer supplement to the developing device.

10. The image forming apparatus according to claim 1, wherein at least the image bearing member and the developing device are unitized as a process cartridge, and the process cartridge is detachably attached to the image forming apparatus.

11. An image forming apparatus comprising:

an image bearing member configured to bear an electrostatic latent image thereon;

a developing device, which is configured to develop the electrostatic latent image with a developer including a toner and a carrier to form a toner image on the image bearing member and which includes:

a developer bearing member configured to bear the developer to develop the electrostatic latent image with the developer at a development region;

a developer containing portion configured to contain the developer;

a developer supplying passage including a developer feeding member configured to feed the developer in a first direction parallel to an axial direction of the developer bearing member to supply the developer to the developer bearing member;

a developer collecting passage including a developer collecting member configured to collect and feed the developer, which passes the development region, in the first direction; and a developer agitating passage including a developer agitating member configured to feed a mixture of the developer, which is fed to a downmost stream side of the developer supplying passage without being used for developing the electrostatic latent image, and the developer collected and fed to a downmost stream side of the developer collecting passage, in a second direction opposite to the first direction while agitating the mixed developer, wherein the developer supplying passage, the developer collecting passage, and the developer agitating passage are separated with a partition from each other, and the developer supplying passage is located over the developer collecting passage and the developer agitating passage while the developer collecting passage and the developer agitating passage are located on substantially a same level;

a developer supplement supplying device configured to supply a developer supplement including the toner and the carrier to the developing device to mix the developer supplement with the mixed developer; and a developer discharging device configured to discharge an excess of the developer from the developing device to replace at least apart of the carrier in the developer with the carrier in the developer supplement, wherein the carrier includes a particulate core material and a cover layer located on the surface of the particulate core material, and wherein the cover layer includes a binder resin and a first particulate material, wherein the cover layer satisfies the following relationship:

$$1<(D1/h)<10,$$

wherein D1 represents a volume average particle diameter of the first particulate material in units of micrometer, and h represents an average thickness of a resinous portion of the cover layer in units of micrometer.

12. The image forming apparatus according to claim 11, wherein the first particulate material includes alumina.

13. The image forming apparatus according to claim 11, wherein the cover layer further includes a second particulate material, and wherein the cover layer further satisfies the following relationship:

$$0.001<(D2/h)<1,$$

wherein D2 represents a volume average particle diameter of the second particulate material in units of micrometer, and h represents the average thickness of the resinous portion of the cover layer in units of micrometer.

14. The image forming apparatus according to claim 13, wherein the second particulate material includes titanium oxide.

15. The image forming apparatus according to claim 11, wherein the cover layer further satisfies the following relationship:

$$0.1\leqq T\leqq 3.0,$$

wherein T represents an average thickness of the cover layer in units of micrometer.

16. The image forming apparatus according to claim 11, wherein the binder resin includes one member selected from reaction products of an acrylic resin and an amino resin, and silicone resins.

17. The image forming apparatus according to claim 11, wherein the developer supplement includes the carrier in an amount of not less than 3% by weight and less than 30% by weight based on a total weight of the developer supplement.

18. The image forming apparatus according to claim 11, wherein the developer contained in the developing device includes the carrier in an amount of from 85 to 98% by weight based on a total weight of the developer in the developing device.

19. The image forming apparatus according to claim 11, wherein the developer supplement supplying device includes a deformable container containing the developer supplement and deforming as the developer supplement is discharged therefrom, and a suction pump configured to suck the developer supplement in the deformable container and feed the developer supplement to the developing device.

20. The image forming apparatus according to claim 11, wherein at least the image bearing member and the developing device are unitized as a process cartridge, and the process cartridge is detachably attached to the image forming apparatus.

* * * * *